US006403292B1

(12) United States Patent
Pawlak et al.

(10) Patent No.: US 6,403,292 B1
(45) Date of Patent: Jun. 11, 2002

(54) DUPLITIZED DISPLAY MATERIAL WITH TRANSLUCENT SUPPORT WITH SPECIFIED FACE TO BACK SPEED DIFFERENTIAL

(75) Inventors: John L. Pawlak, Rochester; Gary J. McSweeney, Hilton; Jerzy Z. Mydlarz; Jerzy A. Budz, both of Fairport; Eric L. Bell, Webster; Alphonse D. Camp, Rochester; Robert P. Bourdelais, Pittsford; Peter T. Aylward, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,689

(22) Filed: Dec. 6, 2000

(51) Int. Cl.[7] ..... G03C 1/46; G03C 1/795; G03C 1/825; G03C 5/29; G03C 7/30

(52) U.S. Cl. ..... 430/434; 430/363; 430/383; 430/502; 430/506; 430/509

(58) Field of Search ..... 430/502, 506, 430/509, 363, 383, 434

(56) References Cited

U.S. PATENT DOCUMENTS

| | | | | |
|---|---|---|---|---|
| 5,037,732 A | | 8/1991 | McDugle et al. | 430/567 |
| 5,219,721 A | | 6/1993 | Klaus et al. | 430/569 |
| 5,314,861 A | | 5/1994 | Morohoshi et al. | 428/195 |
| 5,360,712 A | | 11/1994 | Olm et al. | 430/567 |
| 5,387,501 A | | 2/1995 | Yajima et al. | 430/533 |
| 5,389,422 A | | 2/1995 | Okazaki et al. | 428/141 |
| 5,418,127 A | | 5/1995 | Budz et al. | 430/611 |
| 5,462,849 A | | 10/1995 | Kuromoto et al. | 430/567 |
| 5,466,519 A | | 11/1995 | Shirakura et al. | 430/538 |
| 5,840,473 A | | 11/1998 | Mydlarz et al. | 430/509 |
| 5,849,470 A | | 12/1998 | Mydlarz et al. | 430/509 |
| 5,866,282 A | | 2/1999 | Bourdelais et al. | 430/536 |
| 6,017,685 A | * | 1/2000 | Bourdelais et al. | 430/536 |
| 6,030,756 A | | 2/2000 | Bourdelais et al. | 430/363 |
| 6,071,654 A | * | 6/2000 | Camp et al. | 430/502 |
| 6,074,788 A | | 6/2000 | Bourdelais et al. | 430/18 |
| 6,083,669 A | * | 7/2000 | Bourdelais et al. | 430/533 |
| 6,093,521 A | | 7/2000 | Laney et al. | 430/502 |
| 6,162,549 A | | 12/2000 | Camp et al. | 428/523 |
| 6,291,144 B1 | * | 9/2001 | Aylward et al. | 430/506 |

FOREIGN PATENT DOCUMENTS

| | | |
|---|---|---|
| EP | 0 750 222 | 12/1996 |
| WO | WO 94/04961 | 3/1994 |

* cited by examiner

*Primary Examiner*—Richard L. Schilling
(74) *Attorney, Agent, or Firm*—Paul A. Leipold

(57) ABSTRACT

The invention relates to a photographic element comprising a base material, at least one exposure side photosensitive silver halide layer, and at least one backside photosensitive silver halide layer, wherein said face side photosensitive layer has lower speed than said backside photosensitive layer, and wherein said base material has a percent transmission of between 35 and 60%.

47 Claims, 4 Drawing Sheets

DUPLITIZED DISPLAY MATERIAL WITH TRANSLUCENT SUPPORT WITH SPECIFIED FACE TO BACK SPEED DIFFERENTIAL

FIELD OF THE INVENTION

This invention relates to photographic materials. In a preferred form it relates to a duplitized photographic reflection and transmission display material.

BACKGROUND OF THE INVENTION

It is known in the art that photographic display materials are utilized for advertising as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters and fine art photography. The desired attributes of a quality, high impact photographic display material are a slight blue density minimum, durability, sharpness and flatness. Cost is also important, as display materials tend to be expensive compared with alternative display material technology such as lithographic images on paper. For display materials, traditional color paper is undesirable as it suffers from a lack of durability for the handling, photo processing and display of large format images.

Prior art photographic display materials historically have been classified as either reflection or transmission. Reflection display material typically is highly pigmented image supports with a light sensitive silver halide coating applied. Reflection display materials are typically used in commercial applications where an image is used to convey an idea or message. An application example of a reflection display material is product advertisement in a public area. Prior art reflection display materials have been optimized to provide a pleasing image using reflective light. Transmission display materials are used in commercial imaging applications and are typically backlit with a light source. Transmission display materials are typically a clear support with a light sensitive silver halide and an incorporated diffuser (to hide the "show through" of the lamps used to provide viewing illumination) or a substantially transparent support coated with a light sensitive silver halide emulsion which requires a diffusing screen to be placed behind the material as a means to obscure the "show through" of the lamps used to provide illumination to the media. Prior art transmission display materials have been optimized to provide a pleasing image when the image is backlit with a variety of light sources. Because prior art reflection and transmission products have been optimized to be either a reflection display image or a transmission display image, two separate product designs must exist in manufacturing and two inventories of display materials must be maintained at the photo-finishing printing site. Further, when the quality of the backlighting for transmission display material is diminished when for example, a backlight bums out or the output of the backlight decreases with the age, the transmission image will appear dark and reduce the commercial value of the image. It would be desirable if an image support could function both as a reflection and transmission display material.

Prior art transmission display materials use a high coverage of light sensitive silver halide emulsion to increase the density of the image compared to photographic reflection print materials. While increasing the coverage does increase the density of the image in transmission space, the time to image development is also increased as the coverage increases. Typically, a high-density transmission display material has a developer time of at least 110 seconds compared to a developer time of 45 seconds or less for photographic print materials. Prior art high-density transmission display materials, when processed, reduce the productivity of the development lab. Further, coating a high coverage of emulsion requires additional drying of the emulsion in manufacturing, which reduces the productivity of emulsion coating machines. It would be desirable if a transmission display material was high in density and had a developer time less than 50 seconds.

Prior art reflection photographic materials with a polyester base use a $TiO_2$ pigmented polyester base onto which light sensitive silver halide emulsions are coated. It has been proposed in WO 94/04961 to use opaque polyester containing 10% to 25% $TiO_2$ for a photographic support. The $TiO_2$ in the polyester gives the reflection display materials an undesirable opalescent appearance. The $TiO_2$ pigmented polyester also is expensive because the $TiO_2$ must be dispersed into the entire thickness, typically from 100 to 180 $\mu$m. The $TiO_2$ used in this fashion also gives the polyester support a slight yellow tint, which is undesirable for a photographic display material. For use as a photographic display material, the polyester support containing $TiO_2$ must be tinted blue to offset the yellow coloration, and this, in turn, results in a loss in desirable whiteness and adding cost to the display material.

Prior art photographic display material uses polyester as a base for the support. Typically the polyester support is from 150 to 250 micrometers thick to provide the required stiffness. Prior art photographic display materials are typically coated with light sensitive silver halide imaging layers on one side of the support. Exposure devices have been built to expose only one side of prior art display materials thus there is little concern for print platen design. For example, exposure devices that use a vacuum roll for holding the media during exposing typically employ slots for vacuum. These slots act as "black traps" (areas were exposing energy will be lost and have little secondary reflection) that in a duplitized emulsion system can result in uneven density of the backside image.

In U.S. Pat. No. 6,030,756 duplitized silver halide imaging layers are discussed for use as a display material. In U.S. Pat. No. 6,030,756, both the top and bottom images are exposed by exposing the top side silver halide imaging layers. The display material in U.S. Pat. No. 6,030,756 is capable of giving a good image when viewed in either reflection or transmission mode; however, the display material in U.S. Pat. No. 6,030,756 suffers from uneven backside image density when placed against a non-uniform reflecting platen.

In simultaneously filed Docket 80,701, U.S. application Ser. No. 09/731,354, titled "POLYOLEFIN BASE DISPLAY MATERIAL WITH TONE ENHANCING LAYER" is disclosed a method to improve the backside imaging efficiency by the addition of a tone enhancing layer in combination with an antihalation layer. This method employs a tone enhancing layer to avoid the problem of greatly diminished imaging efficiency of the backside emulsions that is associated with using an antihalation layer alone. Although the process produces pleasing product, it has been found that the maximum achievable density of the element when viewed in transmission mode is still lower than prior art transmission only display materials. This tends to make images look "flat" and desaturated in comparison to prior art transmission display materials. Further, use of high levels of reflective material in the tone enhancing layer can degrade the color reproduction of the transmission element because of an unwanted increase in blue Dmin. In order to compensate for the less than desired amount of transmission density, the amounts of silver, gel, and coupler can be increased on the backside of the element. However, as more of materials are used for the backside of the element, the total thickness of the coated element is increased, and the process sensitivity of the element is degraded.

PROBLEM TO BE SOLVED BY THE INVENTION

There is a continuing need for an improved product that will present a bright reflective image when viewed directly and also provide a sharp bright image of sufficient dye density when backlit.

SUMMARY OF THE INVENTION

It is an object of the invention to overcome disadvantages of display materials.

It is another object to provide a superior, lower cost, and stronger display material.

It is another object to provide a backside image of sufficient dye density when the only exposing light is on the front side of the display element that is not compromised by uneven densities formed on the backside of the display element.

These and other objects of the invention are accomplished by a photographic element comprising a base material, at least one exposure side photosensitive silver halide layer, and at least one backside photosensitive silver halide layer, wherein said face side photosensitive layer has lower speed than said backside photosensitive layer, and wherein said base material has a percent transmission of between 35 and 60%.

ADVANTAGEOUS EFFECT OF THE INVENTION

The invention provides a material that will, when imaged and developed, result in a bright sharp reflective image when viewed in ambient front surface lighting conditions, as well as allowing for a pleasing image of sufficient dye density when illuminated with a transmission light source. In a preferred form the invention provides a product that has a silver halide image on each side but still retains a single exposure step and short processing time.

DETAILED DESCRIPTION OF THE INVENTION

Figure 1:
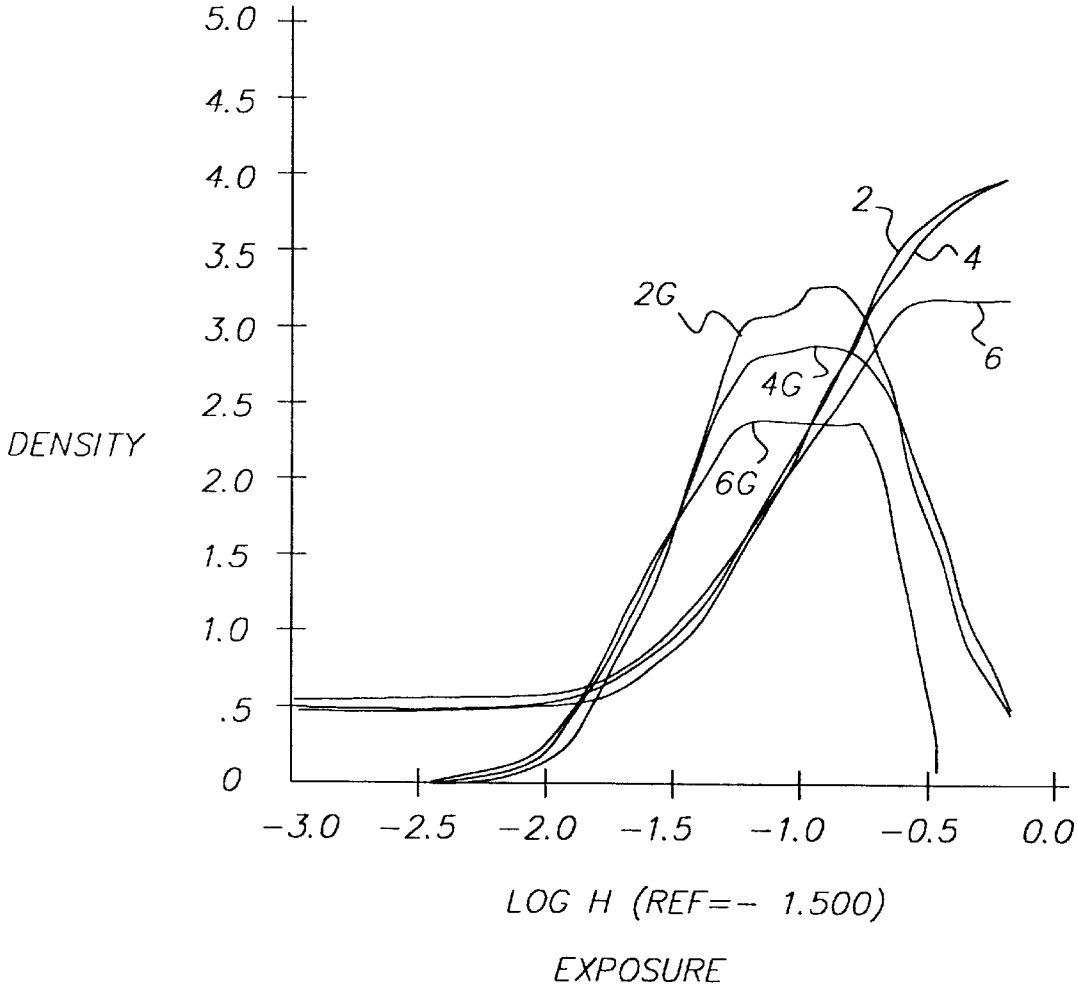
FIG. 1 is a plot of transmission density vs. exposure that demonstrates a comparison duplitized coating that includes an antihalation layer in the backside overcoat and a tone enhancing layer between the overcoat and the bottommost photosensitive layer. Also depicted are the instantaneous gamma plots for the density vs. exposure plots.

Duplitized display materials possessing both reflection properties as well as sufficient dye formed on the backside as a means to present pleasing densities when backlit would be highly desired for display applications. The media would present eye-catching and aesthetically pleasing reflection images, as well as being able to provide pleasing images of sufficient dye densities during nighttime or in low ambient light levels when illuminated from the backside. In addition, the dual property of the formed image (both reflective and transmissive) would allow for pleasing images in outdoor applications or those cases subject to non-controllable high ambient reflection surface lighting (man-made or natural) by the property of the formed front side image. By this invention, the face side image formed and backed by the semi-reflective property of the substrate and illuminated by front surface lighting would not appear "blocked in" as conventional transmission only display media.

This invention relates to the discovery that when a duplitized display material having image forming layers on each side of a translucent support is exposed, the best image is formed if the speed of the image forming emulsion layers on the face side is lower than the speed of the image forming emulsions on the side below the translucent support. The image forming silver halide emulsions below the support receive less light during exposure, as the light must pass through the upper image forming layers, as well as the support prior to exposing the image forming layers on the backside. In this specification when the sensitivity difference between the bottom photosensitive layers and the top photosensitive layers is referred to, this is the effective sensitivity difference, taking into account the fact that the bottom image forming photosensitive layers receive less light during exposure. It has been found that in order to achieve a suitable image, it is preferred that the effective difference in sensitivity of the topside and bottom side layers have no more than about 0.6 log E difference. It is more preferable that the effective sensitivity difference be no more than 0.3 log E. It is most preferable that the effective sensitivity difference between the photosensitive layers above the transparent base and below the transparent base be no more than 0.15 log E for best performance of the photographic element in both reflective and transmission use. The effective sensitivity is the sensitivity of the layer in the photographic element of the invention rather than the sensitivity of the layer if it was separately formed and tested without being a part of the photographic element of the invention. The photographic photosensitive layers below the support receive less light and, therefore, will have an effective sensitivity lower in use than the sensitivity of these layers if they were directly exposed to the light. When the difference in sensitivity of the bottom layers and top layers is referred to in this specification, it is the effective sensitivity difference and not the difference of the layer measured when not a part of the invention photographic element. Therefore, while the photographic layers are referred to as preferably not having a significance difference in sensitivity, it is understood that this is the difference in effective sensitivity in the element, and that in reality the bottom layers, if separated from the photographic element and tested, would actually have a higher speed than the top layers.

The face to back sensitivity differential or "speed gap" can be measured in a number of ways. For instance, the duplitized photographic element can be given a stepped exposure and processed in a normal fashion. After development, alternately either the face or back is stripped away from the support, and the densities of the face or back alone are measured using a transmission densitometer through the face of the element. In this manner, the sensitivity of the face side and backside can be separately determined.

The invention is accomplished by a display material comprising a translucent base wherein said display material will have a light transmission of between 35 and 60% in the developed D-min areas of the display material after exposure and development, at least one photosensitive silver halide layer on the topside of said base and at least one photosensitive layer on the bottom side of said base wherein the difference in sensitivity of the topside and bottom side photosensitive silver halide layers is no more than 0.6 log E. More preferably, this sensitivity difference should be no more than 0.3 log E and most preferably, this sensitivity difference should be no more than 0.15 log E.

In a preferred embodiment, said base of the element is a polyolefin or polyester sheet comprising at least one voided polyolefin or polyester diffusion layer. Further, it is contemplated that the element with the specified face to back sensitivity difference is used in combination with a tone enhancing layer and/or an antihalation layer below the bottom side photosensitive emulsion containing layer.

In a most preferred embodiment these and other objects of the invention are accomplished by a display material comprising a base, said base comprising a polyolefin sheet comprising at least one voided polyolefin diffusion layer, at least one photosensitive silver halide layer on the topside of said base and at least one photosensitive layer on the bottom side of said base, below said bottom side emulsion a tone enhancing layer and below said tone enhancing layer an antihalation layer wherein said display material will have a light transmission of between 35 and 60% in the developed D-min areas of the display material after exposure and development and wherein the difference in sensitivity of the topside and bottom side photosensitive silver halide layers is no more than 0.6 log E. More preferably, this sensitivity difference should be no more than 0.3 log E and most preferably, this sensitivity difference should be no more than 0.15 log E.

For this invention, both a "primary first exposure" and an automatic "secondary exposure" of the backside emulsion occur when exposed from only the front side. This is caused by the designed backscatter of the media and compensates for the initial loss of the imaging radiation caused by imaging through the front side of the media and passing through both front side absorber dyes, as well as the turbid support prior to reaching the backside light sensitive layers. In this fashion, a mirror image of the front side image of sufficient sharpness and sufficient dye density is formed on the backside. This allows for both proper image registration (low to no flare of the backside image), as well as sufficient dye density to survive backlighting. It has been found that duplitized display materials that employ a tone enhancing layer in combination with an antihalation layer can be printed to give either an excellent reflection image or an excellent transmission image. When the print is optimized for reflection viewing, the print viewed by transmission tends to be "flat" and "washed out." Conversely, when the print is optimized for transmission viewing, the reflection print is "blocked in" and dark. In addition, when the element is exposed so that sufficient density is formed for a transmission viewed print, yellow colors tend to be rendered orange, and green colors are undesirably dark. Further, for multicolor elements it has been found that a mismatch in face to back speed gaps, a neutral reflection and transmission tone scale cannot be simultaneously attained.

It has been found that these problems can be overcome by employing any suitable method to decrease the face to back sensitivity difference of the element. The effective speed of the same photosensitive emulsions coated on both the face or backside of the element as described in either U.S. Pat. No. 6,030,756 or simultaneously filed herewith and titled "POLYOLEFIN BASE DISPLAY MATERIAL WITH TONE ENHANCING LAYER" can be more than 0.6 log E. We have found that as the face to back speed gap is reduced, the effective contrast of the system can be dramatically improved which, in turn, enables the inventive element to provide prints that demonstrate both excellent reflection and transmission properties. The impact on sensitometric performance of the material is that as the speed gap is narrowed, the effective transmission contrast is increased, while the reflection contrast is unaltered. In terms of the impact on the photographic element, as transmission contrast is increased, it becomes possible to achieve a better balance between reflection and transmission viewing of the Day/Night product. That is, when the material is illuminated only on the front surface, the element can provide a pleasing reflection print that is not too dark and has a desirable tone scale that can reproduce both highlight and shadow details. When this element is viewed with back illumination in transmission mode, there is sufficient additional density formed on the back of the element so that the print does not appear washed out or flat and, instead, retains the snap and color purity of current transmission only display products.

A variety of methods have been found to narrow the face to back speed gap. As was disclosed in U.S. Pat. No. 5,840,473 and U.S. Pat. No. 5,849,470, materials such as TSS can be used to selectively reduce the speed of the face side emulsions. This material can either be added during the preparation of the silver halide emulsions, or can be added as a so-called melt doctor just prior to the coating operation. Other methods to decrease the emulsion sensitivity are disclosed in U.S. Pat. No. 5,219,721 and U.S. Pat. No. 5,418,127.

It has also been shown that the addition of absorber dye to the face side emulsion pack can reduce the face to back speed gap. As absorber dye level is increased on the face side, the impact on emulsion sensitivity is greater on the face than on the back of the element. Thus, although the sensitivity of the entire element is reduced, the relative sensitivity of the face is reduced in comparison to the back.

Another method to narrow the speed gap is to use silver halide emulsions with intrinsically different sensitivities on the face and back of the element. There are numerous methods available to affect emulsion sensitivity. For instance, it is well known that decreasing grain size can give a slower emulsion. Another option is the presence of absence of certain materials within the grain. For example, the silver halide emulsions for display products generally have a high chloride content, but may also contain lesser amount of bromide and iodide. Bromide ion is generally located at the surface and helps in the adsorption of spectral sensitizing dyes and other photographic addenda to the silver halide grain. It has been disclosed in EP 750,222 that the presence of small amounts of iodide can have a very beneficial impact on the sensitivity of a high chloride emulsion. Further, U.S. Pat. Nos. 5,037,732; 5,360,712; and 5,462,849 disclose the use of organic ligand containing dopants that can radically alter emulsion sensitivity, while having minimal impact on other important characteristics such as contrast and reciprocity.

FIG. 1 is a plot of transmission density on the vertical axis, in units of Status A red/green/blue density and log exposure on the horizontal axis. FIG. 1 was generated by applying the duplitized silver halide coating to the preferred base of the invention with an antihalation layer and a tone enhancing layer and separation exposing on with red, green, and blue lasers with a uniform black backing platen, followed by processing in conventional RA-4 chemistry and then reading on a Transmission X-Rite densitometer. The three curves are for the cyan 2, the magenta 4, and the yellow 6 color records. Also shown are the instantaneous gamma (or contrast) plots derived from the density vs. log exposure plots for the cyan (2G), the magenta (4G), and the yellow (6G) records. FIG. 1 represents the performance of a duplitized silver halide display materials that has emulsions of equal sensitivity to light on both the face and backsides of the element. Although an image with acceptable transmission quality can be obtained, the materials in FIG. 1 do not give prints that have simultaneously optimized reflection and transmission viewing properties.

Figure 2:
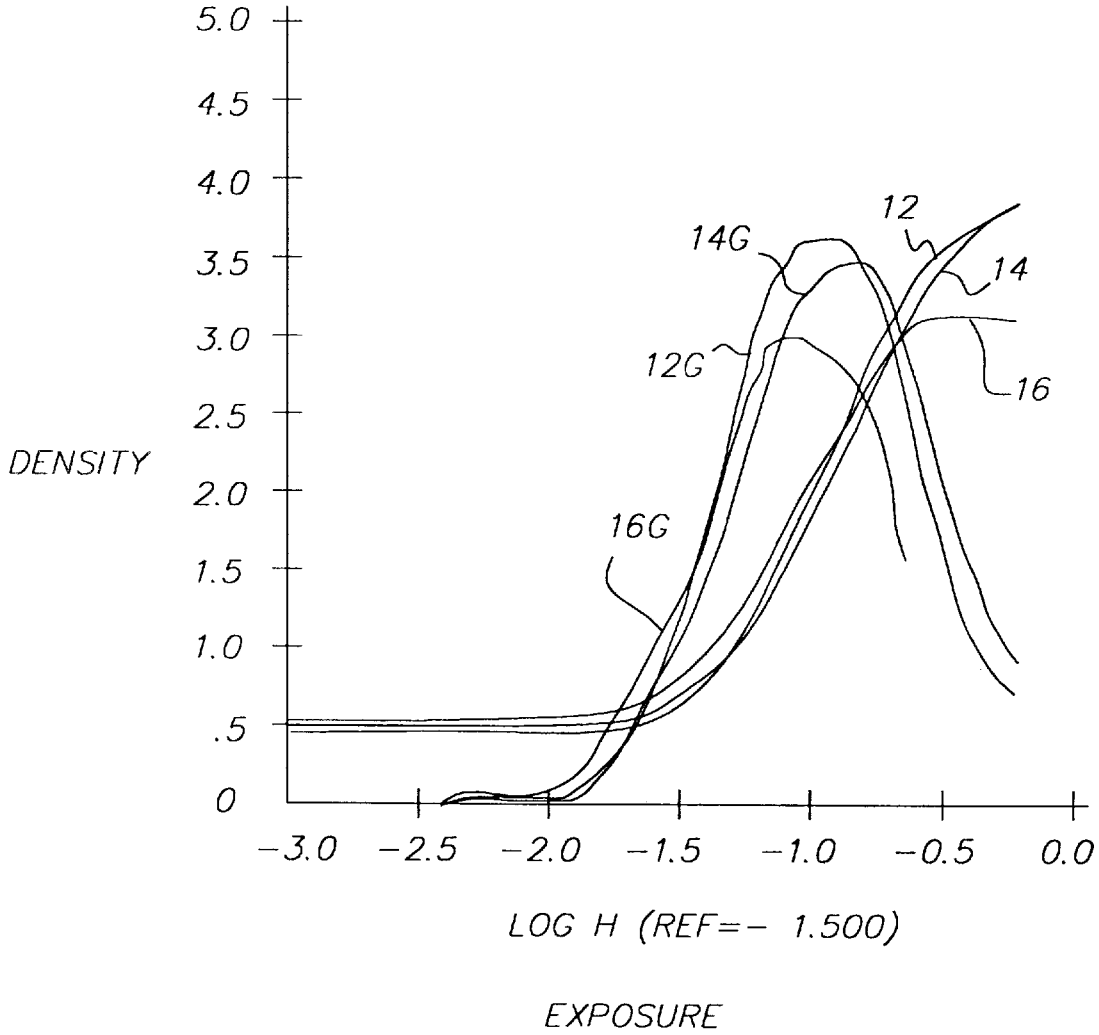
FIG. 2 is a plot of transmission density vs. exposure that demonstrates the inventive duplitized coating with melt addendum capable of reducing the silver halide sensitivity of the face side emulsions. Also depicted are the instantaneous gamma plots for the density vs. exposure plots.

FIG. 2 is a plot of density on the vertical axis, in units of Status A red/green/blue density and log exposure on the horizontal axis. FIG. 2 was generated by applying the duplitized silver halide coating to the preferred base of the invention with an antihalation layer, a tone enhancing layer, and use of a speed attenuation addendum added to the red, green, and blue photosensitive emulsion layers and separation exposing on with red, green, and blue lasers with a uniform black backing platen, followed by processing in conventional RA-4 chemistry and then reading on a Transmission X-Rite densitometer. The three curves are for the cyan 12, the magenta 14, and the yellow 16 color records. Also shown are the instantaneous gamma plots derived from the density vs. log exposure plots for the cyan (12G), the magenta (14G) and the yellow (16G) records. FIG. 2 represents the performance of the invention in which enough of the speed attenuation agent was added to reduce photosensitivity of the face side layers by approximately 0.15 log E in relation to the comparison coating. As seen with both the density vs. log E curves and the instantaneous gamma plots, the overall contrast of the system was increased in relation to the comparison.

Figure 3:
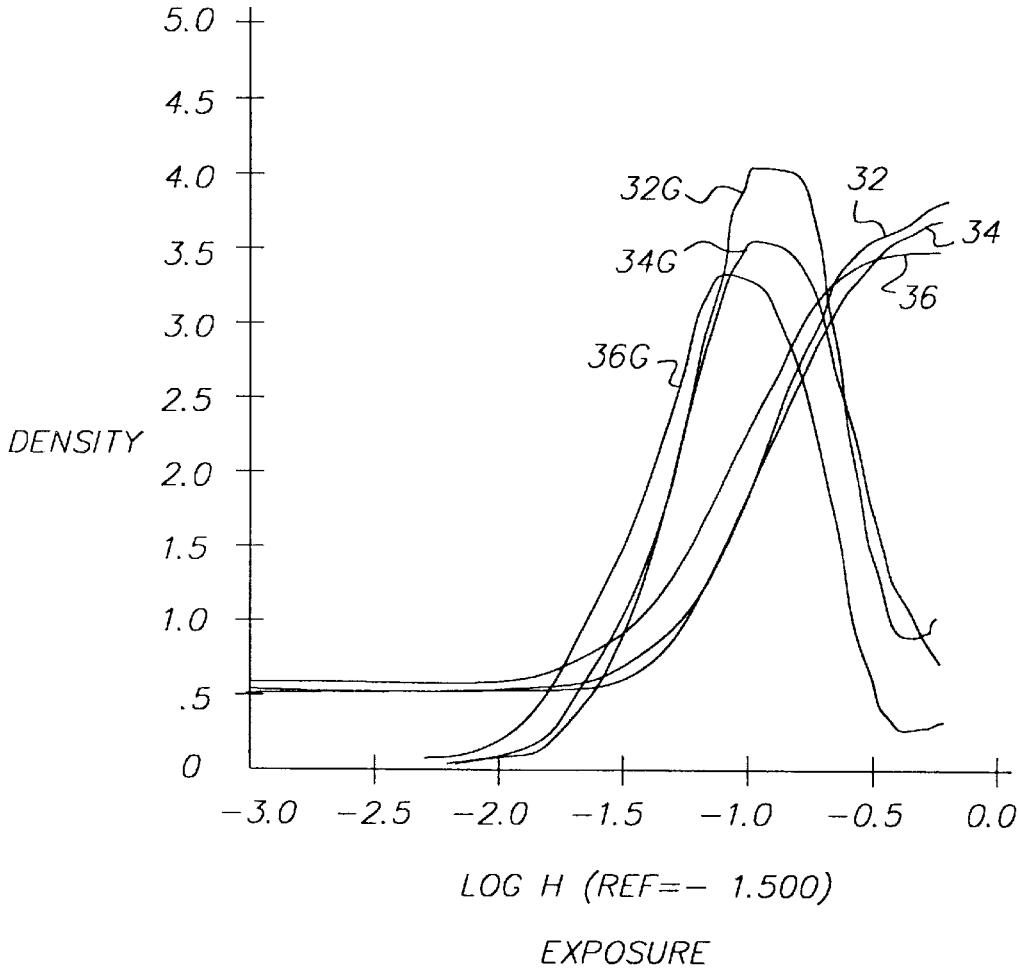
FIG. 3 is a plot of transmission density vs. exposure that demonstrates the inventive duplitized coating with melt addendum capable of reducing the silver halide sensitivity of the face side emulsions in combination with triple the comparison level of face side absorber dyes. Also depicted are the instantaneous gamma plots for the density vs. exposure plots.

FIG. 3 is a plot of density on the vertical axis, in units of Status A red/green/blue density and log exposure on the horizontal axis. FIG. 3 was generated by applying the duplitized silver halide coating to the preferred base of the invention with an antihalation layer, a tone enhancing layer, a speed attenuation addendum added to the red, green, and blue photosensitive emulsion layers and three times the absorber dye as used in the comparison and separation exposing on with red, green, and blue lasers with a uniform black backing platen, followed by processing in conventional RA-4 chemistry and then reading on a Transmission X-Rite densitometer. The three curves are for the cyan 22, the magenta 24, and the yellow 26 color records. Also shown are the instantaneous gamma plots derived from the density vs. log exposure plots for the cyan (22G), the magenta (24G), and the yellow (26G) records. FIG. 3 represents the performance of the invention in which enough of the speed attenuation agent was added to reduce photosensitivity of the face side layers by approximately 0.15 log E in relation to the comparison coating, and three times the comparison level of absorber dye was added to the face side coatings. As seen with both the density vs. log E curves and the instantaneous gamma plots, the overall contrast of the system was increased even further in relation to the comparison.

Figure 4:
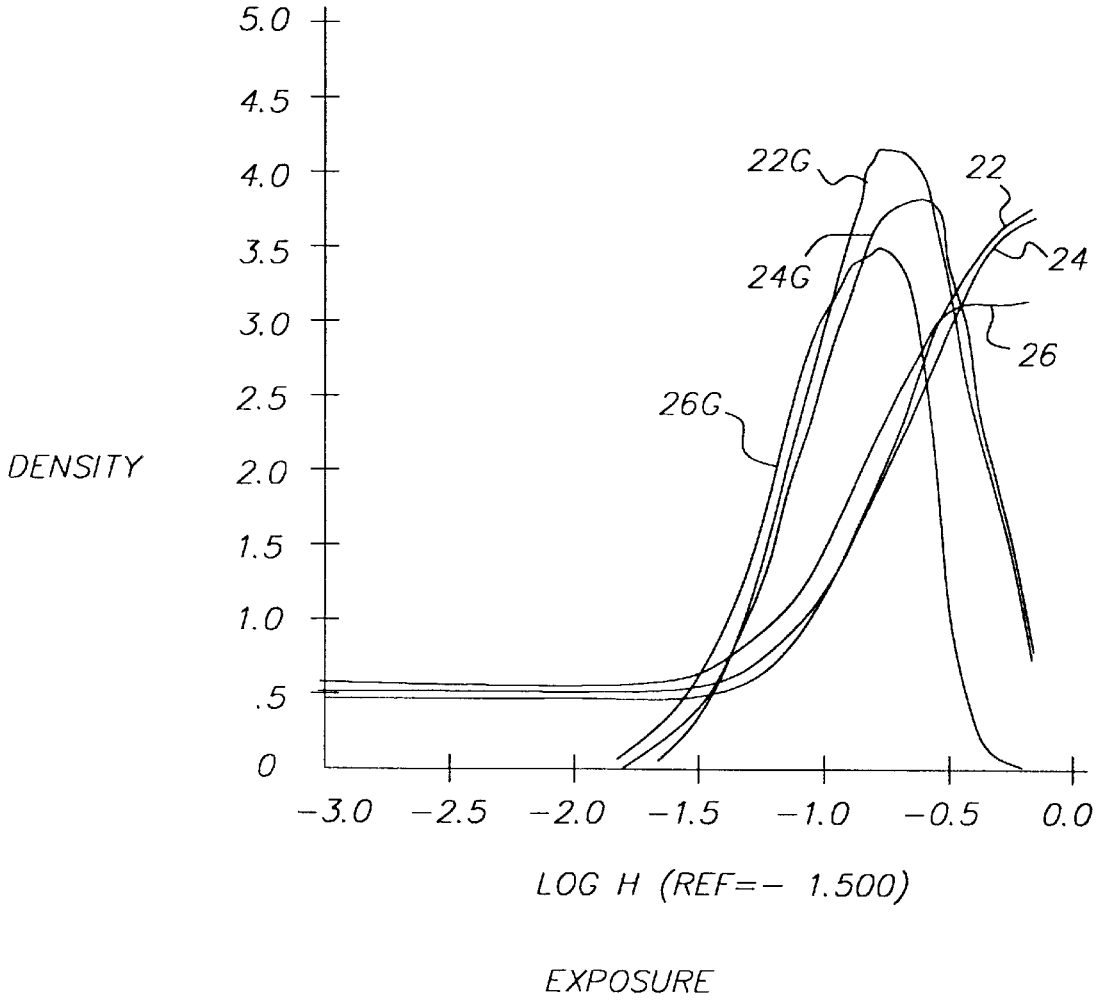
FIG. 4 is a plot of transmission density vs. exposure that demonstrates a third embodiment of the invention in which a unique set of emulsions with inherently lower sensitivity &re used on the face side of the element. Also depicted are the instantaneous gamma plots for the density vs. exposure plots.

FIG. 4 is a plot of density on the vertical axis, in units of Status A red/green/blue density and log exposure on the horizontal axis. FIG. 4 was generated by applying the duplitized silver halide coating to the preferred base of the invention with an antihalation layer, a tone enhancing layer, and three new face side silver halide emulsions that were approximately 0.6 log E (red and green) and 0.15 log E (blue) less sensitive than the emulsions used in the backside of the element and separation exposing on with red, green, and blue lasers with a uniform black backing platen, followed by processing in conventional RA-4 chemistry and then reading on a Transmission X-Rite densitometer. The three curves are for the cyan 32, the magenta 34, and the yellow 36 color records. Also shown are the instantaneous gamma plots derived from the density vs. log exposure plots for the cyan (32G), the magenta (34G) and the yellow (36G) records. As seen with both the density vs. log E curves and the instantaneous gamma plots, the overall contrast of the system was increased even in relation to the comparison shown in FIG. 1.

The terms as used herein, "top", "upper", and "face" relate to the side that is facing the exposure source. The terms "bottom", "lower", and "back" mean the side that is farther from the exposure source. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{-}D*100$ where D is the average of the red, green, and blue Status A transmission density response of the processed minimum density of the photographic element as measured by an X-Rite model 310 (or comparable) photographic transmission densitometer. The term as used herein, "duplitized" means light sensitive silver halide coating on the top side and the bottom side of the imaging support.

In one embodiment of this invention, the display material uses a clear polyester support in combination with a layer that contains a white pigment dispersed in gelatin as an incorporated diffuser, and said diffuser layer is coated adjacent to the base on the face side of the element. Suitable diffuser materials include, but are not limited to, titanium dioxide, barium sulfate, clay, calcium carbonate or suitable polymeric materials. Suitable polymeric materials include hollow polystyrene beads such as Ropaque™ beads (HP-1055, Rohm & Haus). Most preferred is $TiO_2$, which may be either of the anatase or rutile type.

In a preferred embodiment, the display material uses a base comprising a polyolefin or polyester sheet comprising at least one voided polyolefin or polyester diffusion layer. This invention provides a stronger material, as the biaxially oriented polyolefin sheet provides flexural rigidity. The material, as it contains in its preferred form silver halide imaging layers on both sides of a polymer sheet, may be imaged by a collimated beam exposure device in a single exposure. As there are two relatively thin layers of silver halide image materials, the developing of the invention element may be carried out rapidly as the penetration of the developing solution is rapid through the thin layers of imaging material, allowing greater productivity in a commercial printing lab. The material of the invention is lower in cost since less material needs to be coated in order to achieve the same sensitometric performance.

In a more preferred embodiment the duplitized display material uses a base comprising a polyolefin sheet comprising at least one voided polyolefin diffusion layer, and beneath the bottommost photosensitive layer is a tone enhancing layer, and beneath the tone enhancing layer is an antihalation layer. The tone enhancing layer allows for a tunable secondary exposure, while the antihalation layer eliminates the impact of non-uniform printing platens. Thus, the material of the invention is robust to exposure devices as the materials added to the bottommost layers allow for different exposure devices to be utilized for the formation of quality images. The material of the invention is robust during photoprocessing due to the lower laydown of materials, particularly in the backside of the element. The invention material allows for the simultaneous exposure of both the top and bottom imaging layers, while preventing the effects of printer backscatter which would significantly degrade the quality of the image. The structure of the media allows for a pleasing reflection image when the image is captured in a light box containing an air gap from the illumination lamps used for transmission viewing, while also providing uniform diffusion of the transmission illumination source to provide a pleasing transmission image. The invention materials ensure that the front side and backside form dye densities after processing results when measured by Status A transmission densitometry in a continuous and uninterrupted curve shape substantially free from non-uniformities caused by an incorrect speed offset of the front side and backside emulsions. The invention materials allow the formation of an excellent transmission image that simultaneously has pleasing reflection viewing properties. These and other advantages will be apparent from the detailed description below.

As used herein, the phrase "photographic element" is a material that utilizes photosensitive silver halide in the formation of images. The photographic elements can be black-and-white, single color elements, or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

For the display material of this invention, at least one image layer containing silver halide and a dye forming coupler located on both the topside and bottom side of said imaging element. Applying the imaging layer to either the top and bottom is suitable for a photographic display material, but it is not sufficient to create a photographic display material that is optimum for both a reflection display and a transmission display. Applying an imaging layer to both the top and bottom of the support allows for the display material to have the required density for both reflective viewing and for transmission viewing of the image. This duplitized "day/night" photographic display material has significant commercial value in that the day/night display material can be used for both reflective viewing and transmission viewing. Prior art display materials were optimized for either transmission viewing or reflective viewing, but not both simultaneously.

It has been found that each side of the duplitized emulsion coverage should be in a range that is greater than 75% and less than 175% of typical emulsion coverages for reflective consumer paper that contain typical amounts of silver and coupler. At coverages of less than 75% on the front side, it was found that a pleasing reflection print could not be obtained. Further, at coverages of less than 75% on the backside, pleasing transmission images could not be obtained. Coverages greater than 175% are undesirable because of the increased material expense and also because of the need for extended development times in the processing solutions. In a more ;A preferred embodiment, emulsion lay downs on each side should be between 100–150% of that found for a typical reflective consumer color paper.

The display material of this invention wherein the amount of dye forming coupler is substantially the same on the top and bottom sides is most preferred because it allows for optimization of image density, while allowing for developer time less than 50 seconds. Further, coating substantially the same amount of light sensitive silver halide emulsion on both sides has the additional benefit of balancing the imaging element for image curl caused by the contraction and expansion of the hygroscopic gel typically found in photographic emulsions.

The use of a tone enhancing layer, as described in the above-referenced companion filing of simultaneously filed Docket 80,701 titled "POLYOLEFIN BASE DISPLAY MATERIAL WITH TONE ENHANCING LAYER", provides a tunable "secondary exposure" capability, and when used in combination with an antihalation layer to defeat any non-uniform reflectivity resulting from any backing platen or stray backlight in the printer, much improved images result. This tone enhancing layer is comprised of a component capable of reflecting light with minimal scatter. Suitable materials include, but are not limited to, titanium dioxide, barium sulfate, clay, calcium carbonate, or suitable polymeric materials. Suitable polymeric materials include hollow polystyrene beads such as Ropaque beads (HP-1055, Rohm & Haus). Most preferred is $TiO_2$, which may be either of the anatase or rutile type.

Many types of photographic elements typically comprise some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby re-exposed at locations different from the original light path through the emulsion, resulting in "halos" on the film surrounding images of bright objects.

A variety of methods for antihalation protection have been proposed in the art. These methods include the use of an antihalation hydrophilic colloid layer containing filter dyes or silver metal coated beneath the emulsion layers. The filter dyes or silver are solubilized and removed during processing of the film without removal of the hydrophilic colloid layer itself. For hydrophilic colloid antihalation and filter layers coated on the same side of the support as light sensitive emulsion layers of a photographic element, filter dyes are typically incorporated into such layers as water soluble dyes, as conventional oil-in-water dispersions, as loaded polymeric latex dispersions, or as aqueous solid particle dispersions such as described in U.S. Pat. No. 5,657,931. Other methods for antihalation are described in section VIII of *Research Disclosure*, September 1994, Item 36544, Section I, published by Kenneth Mason Publications, Ltd., Dudley Annex, 12a North Street, Emsworth, Hampshire PO10 7DQ, ENGLAND.

The layers of the biaxially oriented polyolefin sheet of this invention have levels of voiding, $TiO_2$ and colorants adjusted to provide optimum transmission and reflection properties. The biaxially oriented polyolefin sheet in a preferred embodiment is laminated to a transparent polymer base for stiffness, for efficient image processing, as well as product handling and display. An important aspect of this invention is that the imaging support is coated with a light sensitive silver halide emulsion on the topside and the bottom side. This duplitized silver halide coating, combined with the optical properties of the biaxially oriented sheet and the intelligent placement of a $TiO_2$ layer in the backside, provides a photographic display material that can be used in both reflection and transmission that has superior secondary image forming capability while maintaining antihalation protection. The "dual" display material of this invention has significant commercial value in that prior art photographic display materials function as either a reflection display or a transmission display, while only the invention photographic elements have ability to work in both modes in a variety of printers having shiny or differential reflective properties of the backing platen employed.

Since the display material can function in both transmission and reflection, inventories can be consolidated in manufacturing and at the processing lab. Further, concentration of the tint materials and the white pigments in the biaxially oriented sheet allows for improved manufacturing efficiency and lower material utilization resulting in a lower cost display material. The a* and L* for the invention are consistent with high quality transmission display materials. The invention would be lower in cost over prior art materials as a 102 μm polyester base was used in the invention compared to a 178 μm polyester for prior art photographic display materials.

Any suitable biaxially oriented polyolefin sheet may be utilized as part of the laminated diffuse base of the invention. Microvoided composite biaxially oriented sheets are preferred because the voids provide opacity without the use of $TiO_2$. Microvoided composite oriented sheets are conveniently manufactured by co-extrusion of the core and surface layers, followed by biaxial orientation, whereby voids are formed around void-initiating material contained in the core layer. Such composite sheets are disclosed in, for example, U.S. Pat. Nos. 4,377,616; 4,758,462 and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\ \text{of Solid Density}$$

This value should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 μm, preferably from 20 to 70 μm. Below 20 μm, the microvoided sheets may not be thick enough to minimize any inherent non-planarity in the support and would be more difficult to manufacture. At thickness higher than 70 μm, little improvement in either surface smoothness or mechanical properties are seen, and so there is little justification for the further increase in cost for extra materials.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula $Ar—C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with a agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

The total thickness of the top most skin layer or exposed surface layer should be between 0.20 micrometers and 1.5 micrometers, preferably between 0.5 and 1.0 micrometers. Below 0.5 micrometers any inherent non-planarity in the coextruded skin layer may result in unacceptable color variation. At skin thickness greater than 1.0 micrometers, there is a reduction in the photographic optical properties such as image resolution. At thickness greater that 1.0 micrometers there is also a greater material volume to filter for contamination such as clumps, poor color pigment dispersion, or contamination. Low density polyethylene with a density of 0.88 to 0.94 g/cc is the preferred material for the top skin because current emulsion formulation adhere well to low density polyethylene compared to other materials such as polypropylene and high density polyethylene.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are preferred as temperatures greater than 320° C. are necessary for coextrusion of the skin layer. Blue colorants used in this invention may be any colorant that does not have an adverse impact on the imaging element. Preferred blue colorants include phthalocyanine blue pigments, cromophtal blue pigments, Irgazin blue pigments, Irgalite organic blue pigments, and pigment Blue 60.

It has been found that a very thin coating (0.2 to 1.5 micrometers) on the surface immediately below the top emulsion layer can be made by coextrusion and subsequent stretching in the width and length direction. It has been found that this layer is, by nature, extremely accurate in thickness and can be used to provide all the color corrections which are usually distributed throughout the thickness of the sheet between the emulsion and the paper base. This topmost layer is so efficient that the total colorants needed to provide a correction are less than one-half the amount needed if the colorants are dispersed throughout thickness. Colorants are often the cause of spot defects due to clumps and poor dispersions. Spot defects, which decrease the commercial value of images, are improved with this invention because less colorant is used and high quality filtration to clean up the colored layer is much more feasible since the total volume of polymer with colorant is only typically 2 to 10% of the total polymer between the base paper and the photosensitive layer.

While the addition of $TiO_2$ in the thin skin layer of this invention does not significantly contribute to the optical performance of the sheet, it can cause numerous manufacturing problems such as extrusion die lines and spots. A skin layer substantially free of $TiO_2$ is preferred. $TiO_2$ added to a layer between 0.20 and 1.5 $\mu$m does not substantially improve the optical properties of the support, will add cost to the design, and will cause objectionable pigments lines in the extrusion process.

Addenda may be added to the top biaxially oriented sheet of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to white defined as a negative b* compared to a white, white defined as a b* within one b* unit of zero. b* is the measure of yellow/blue in CIE space. A positive b* indicates yellow while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the reflection b* difference measured when a sample is illuminated by an ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the biaxially oriented sheet. An emission greater that 5 b* units would interfere with the color balance of the prints making the whites appear too blue for most consumers.

The preferred addendum of this invention is an optical brightener. An optical brightener is a colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1,4-bis (o-cyanostyryl)benzol, and 2-amino-4-methyl phenol.

The optical brightener may be added to any layer in the multilayer coextruded biaxially oriented top polyolefin sheet. The preferred location is adjacent to or in the exposed surface layer of said sheet. This allows for the efficient concentration of optical brightener which results in less optical brightener being used when compared to traditional photographic supports. When the desired weight % loading of the optical brightener begins to approach the concentration at which the optical brightener migrates to the surface of the support forming crystals in the imaging layer, the addition of optical brightener into the layer adjacent to the exposed layer is preferred. When optical brightener migration is a concern as with light sensitive silver halide imaging systems, the preferred exposed layer is comprised of polyethylene. In this case, the migration from the layer adjacent to the exposed layer is significantly reduced, allowing for much higher optical brightener levels to be used to optimize image quality. Locating the optical brightener in the layer adjacent to the exposed layer allows for a less expensive optical brightener to be used as the exposed layer, which is substantially free of optical brightener, prevents significant migration of the optical brightener. Another preferred method to reduce unwanted optical brightener migration is to use polypropylene for the layer adjacent to the exposed surface. Since optical brightener is more soluble in polypropylene than polyethylene, the optical brightener is less likely to migrate from polypropylene.

The microvoided core of the biaxially oriented sheet of this invention also increases the opacity of the image element without the use of $TiO_2$ or other white pigments. During the printing process in which a latent image is formed in the image layers, simultaneous exposure of imaging layers of the top and bottom sides is preferred to reduce development time and increase image density. $TiO_2$ in the support structure will tend to scatter the exposure light causing unwanted exposure. The voided layer while providing opacity also allows for the transmission of light without unwanted exposure.

The biaxially oriented sheet may also contain pigments which are known to improve the photographic responses such as whiteness or sharpness. Titanium dioxide is used in this invention to improve image sharpness. The $TiO_2$ used may be either anatase or rutile type. In the case of optical properties, rutile is the preferred because of the unique particle size and geometry. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments to improve photographic responses may also be used in this invention such as titanium dioxide, barium sulfate, clay, or calcium carbonate.

The preferred amount of $TiO_2$ added to the biaxially oriented sheet of this invention is between 3 and 18% by weight. Below 2% $TiO_2$, the required reflection density of the biaxially oriented sheet is difficult to obtain. Above 20%, the desired transmission characteristics are difficult to obtain. Further, above 20% $TiO_2$, manufacturing efficiency declines because of melt extrusion problems associated with the use of $TiO_2$ such as plate out on the screw, die manifold, and die lips.

For a display material to function both as a reflection display and a backlit transmission display material, the support must function as an acceptable reflective support and allow enough light to be transmitted so that support can also function as a transmission material. Further, transmission and reflection properties must be managed so that the photographic display material can be simultaneously exposed on the top side and bottom sides. The preferred exposure method is from the top side of the imaging element. Simultaneous exposure is performed by light exposing the top side light sensitive coating, traveling through the support structure and exposing the bottom side light sensitive coating.

Due to the nature of transmission viewing materials with incorporated diffusers (the fact that the materials are captured or suspended in a viewing box which contains an illumination source and an air interface between the illumination source and the display material), a more transmissive display material can be tolerated and still appear sufficiently opaque in the reflection mode while allowing for maximum transmission when used in a back lit mode. This transmissiveness also enables the image formation step for the duplitized coating as the increased transmissiveness allows for more of the imaging light to reach the backside light sensitive silver halide emulsion coating.

The preferred spectral transmission of the biaxially oriented polyolefin sheet of this invention is less than 50%. Spectral transmission is the amount of light energy that is transmitted through a material. For a photographic element, spectral transmission is the ratio of the transmitted power to the incident power and is expressed as a percentage as follows: $T_{RGB}=10^{-D}*100$ where D is the average of the red, green, and blue Status A transmission density response of a processed minimum density measured by an X-Rite model 310 (or comparable) photographic transmission densitometer. The higher the transmission, the less opaque the material. For a reflection display material, the quality of the image is related to the amount of light reflected from the image to the observer's eye. A reflective image with a high amount of spectral transmission does not allow sufficient light to reach the observer's eye causing a perceptual loss in image quality. A reflective image with a spectral transmission of greater than 55% is unacceptable for a reflection display material as the quality of the image can not match prior art reflection display materials.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. A stretching ratio, defined as the final length divided by the original length for sum of the machine and cross directions, of at least 10 to 1 is preferred. After the sheet has been stretched, it is heat set by heating to a temperature sufficient to crystallize or anneal the polymers while restraining to some degree the sheet against retraction in both directions of stretching.

The composite top sheet, while described as having preferably at least three layers of a core and a skin layer on each side, may also be provided with additional layers that may serve to change the properties of the biaxially oriented sheet. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented sheet where the exposed surface layer is adjacent to the top imaging layer is as follows:

Polyethylene skin (optionally with red, green or blue pigments)
Polypropylene with $TiO_2$ and optical brightener
Polypropylene microvoided layer
Polypropylene bottom skin layer (optionally with $TiO_2$)

The support to which the microvoided composite sheets and biaxially oriented sheets are laminated for the laminated support of the photosensitive silver halide layer may be any material with the desired transmission and stiffness properties. Photographic elements of the invention can be prepared on any suitable transparent photographic quality support including sheets of various kinds of synthetic paper such as polystyrene, synthetic high molecular weight sheet materials such as polyalkyl acrylates or methacrylates, polystyrene, polyamides such as nylon, sheets of semi-synthetic high molecular weight materials such as cellulose nitrate, cellulose acetate butyrate, and the like; homo- and copolymers of vinyl chloride, poly(vinylacetal), polycarbonates, homo- and copolymers of olefins such as polyethylene and polypropylene, and the like.

Polyester sheets are particularly advantageous because they provide excellent strength and dimensional stability. Such polyester sheets are well known, widely used and typically prepared from high molecular weight polyesters prepared by condensing a dihydric alcohol with a dibasic saturated fatty acid or derivative thereof.

Suitable dihydric alcohols for use in preparing such polyesters are well known in the art and include any glycol wherein the hydroxyl groups are on the terminal carbon atom and contain from two to twelve carbon atoms such as, for example, ethylene glycol, propylene glycol, trimethylene glycol, hexamethylene glycol, decamethylene glycol, dodecamethylene glycol, 1,4-cyclohexane, dimethanol, and the like.

Suitable dibasic acids useful for the preparation of polyesters include those containing from two to sixteen carbon atoms such as adipic acid, sebacic acid, isophthalic acid, terephtalic acid and the like. Alkyl esters of acids such as those listed above can also be employed. Other alcohols and acids as well as polyesters prepared therefrom and the preparation of the polyesters are described in U.S. Pat. Nos. 2,720,503 and 2,901,466. Polyethylene terephthalate is preferred.

Polyester support thickness can range from about 15 millinewtons to 100 millinewtons. The preferred stiffness is between 20 and 100 millinewtons. Polyester stiffness less than 15 millinewtons does not provide the required stiffness for display materials in that they will be difficult to handle and do not lay flat for optimum viewing. Polyester stiffness greater than 100 millinewtons begins to exceed the stiffness limit for processing equipment and has no performance benefit for the display materials.

Generally polyester sheets supports are prepared by melt extruding the polyester through a slit die, quenching to the amorphous state, orienting by machine and cross direction stretching and heat setting under dimensional restraint. The polyester sheet can also be subjected to a heat relaxation treatment to improve dimensional stability and surface smoothness.

The polyester sheet will typically contain an undercoat or primer layer on both sides of the polyester sheet. Subbing layers used to promote adhesion of coating compositions to the support are well known in the art and any such material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is usually overcoated with a second subbing layer comprised of gelatin, typically referred to as gel sub. The base also may be a microvoided polyethylene terephthalate such as disclosed in U.S. Pat. Nos. 4,912,333; 4,994,312; and 5,055,371.

A transparent polymer voided base free of $TiO_2$ is preferred because the voided polymer layer provides a desirable opalescent appearance for the display market. The $TiO_2$ pigmented transparent polymer also is expensive because the $TiO_2$ must be dispersed into the entire thickness, typically from 100 to 180 micrometers. The $TiO_2$ also gives the transparent polymer support a slight yellow tint which is undesirable for a photographic display material. For use as a photographic reflection display material, a transparent polymer support containing $TiO_2$ must also be tinted blue to offset the yellow tint of the polyester causing a loss in desired whiteness and adding cost to the display material. Concentration of the white pigment in the polyolefin layer allows for efficient use of the white pigment which improves image quality and reduces the cost of the imaging support.

When working with polyester sheet base sheets in conjunction with biaxially oriented sheet, static accumulation and discharge becomes a problem. The problem of controlling static charge is well known in the field of photography. The accumulation of charge on sheet or paper surfaces leads to the attraction of dirt, which can produce physical defects. The discharge of accumulated charge during or after the application of the sensitized emulsion layer(s) can produce irregular fog patterns or "static marks" in the emulsion. The static problems have been aggravated by increase in the sensitivity of new emulsions, increase in coating machine speeds, and increase in post-coating drying efficiency. The charge generated during the coating process may accumulate during winding and unwinding operations, during transport through the coating machines, and during finishing operations such as slitting and spooling.

It is generally known that electrostatic charge can be dissipated effectively by incorporating one or more electrically-conductive "antistatic" layers into the sheet structure. Antistatic layers can be applied to one or to both sides of the sheet base as subbing layers either beneath or on the side opposite to the light-sensitive silver halide emulsion layers. An antistatic layer can alternatively be applied as an outer coated layer, either over the emulsion layers or on the side of the sheet base opposite to the emulsion layers or both. For some applications, the antistatic agent can be incorporated into the emulsion layers. Alternatively, the antistatic agent can be directly incorporated into the sheet base itself.

A wide variety of electrically-conductive materials can be incorporated into antistatic layers to produce a wide range of conductivities. These can be divided into two broad groups: (i) ionic conductors and (ii) electronic conductors. In ionic conductors, charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color, increased brittleness, and poor adhesion to the antistatic layer.

In a preferred embodiment of this invention, the display material has an antistat material below the base and above the bottom photosensitive layer. It is desirable to have an antistat that has a electrical surface resistivity of at least $10^{13}$ log ohms/square. In the most preferred embodiment, the antistat material comprises at least one material selected from the group consisting of tin oxide and vanadium pentoxide.

When using polyester base or other transparent polymer base, it is preferable to extrusion laminate the microvoided composite sheets to the base polymer using a polyolefin resin. Extrusion laminating is carried out by bringing together the biaxially oriented sheets of the invention and the polyester base with application of a melt extruded adhesive between the polyester sheets and the biaxially oriented polyolefin sheets, followed by their being pressed in a nip such as between two rollers. The melt extruded adhesive may be applied to either the biaxially oriented sheets or the base polymer prior to their being brought into the nip. In a preferred form, the adhesive is applied into the nip simultaneously with the biaxially oriented sheets and the base polymer. The adhesive used to adhere the biaxially oriented polyolefin sheet to the polyester base may be any suitable material that does not have a harmful effect upon the photographic element. A preferred material is metallocene catalyzed ethylene plastomers that are melt extruded into the nip between the polymer and the biaxially oriented sheet. Metallocene catalyzed ethylene plastomers are preferred because they are easily melt extruded, adhere well to biaxially oriented polyolefin sheets of this invention, and adhere well to gelatin sub coated polyester support of this invention. The extrusion of the polymer utilized for joining the biaxially oriented sheet of the invention to the base may be by extrusion of a monolayer or multiple layers, commonly referred to as co-extrusion.

The polymer base of the invention may also be laminated with a bottom sheet to reduce curl of the imaging element. Curl control technology using a biaxially oriented laminated to both the topside and the bottom side of the support is widely known and described in U.S. Pat. No. 5,866,282 (Bourdelais et al) and U.S. Pat. No. 6,030,742 (Bourdelais et al).

The structure of a preferred reflection/transmission display support where the imaging layers are applied to the biaxially oriented polyolefin sheet is as follows:

Light sensitive imaging layers
Biaxially oriented polyolefin sheet
Metallocene catalyzed ethylene plastomer
Polyester base
Light sensitive imaging layers The topside of the photographic element may be coated either with the biaxially oriented polyolefin sheet up or down with respect to the exposure source. In a most preferred embodiment, the topside of the photographic element is coated nearest the biaxially oriented polyolefin sheet.

The photographic emulsions useful for this invention are generally prepared by precipitating silver halide crystals in a colloidal matrix by methods conventional in the art. The colloid is typically a hydrophilic sheet forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support using known coating techniques such as bead and curtain coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals that reduce silver ions to form metallic silver atoms, or by providing a reducing environment such as high pH (excess hydroxide ion), and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 799,923. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically. sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises a laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The teachings of the invention may also be utilized to produce black and white photographic print elements.

When the base material of the invention with the integral diffusion layer is coated with silver halide photographic element, it is capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above.

This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3, or −4;

M is a filled frontier orbital polyvalent metal ion, other than iridium;

and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

It has been discovered quite surprisingly that the combination of dopants (i) and (ii) provides greater reduction in reciprocity law failure than can be achieved with either dopant alone. Further, unexpectedly, the combination of dopants (i) and (ii) achieves reductions in reciprocity law failure beyond the simple additive sum achieved when employing either dopant class by itself. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer). The advantages of this combination of dopants can be transformed into increased throughput of digital substantially artifact-free color print images while exposing each pixel sequentially in synchronism with the digital data from an image processor.

In one embodiment, the present invention represents an improvement on the electronic printing method. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

It has been unexpectedly discovered that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

It is contemplated to employ a class (i) hexacoordination complex dopant satisfying the formula:

$$[ML_6]^n \quad \text{(I)}$$

wherein n is zero, −1, −2, −3, or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion; and $L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ or to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)Cl_5]^{-4}$ (i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712; Olm et al U.S. Pat. No. 5,457,021; and Kuromoto et al U.S. Pat. No. 5,462,849.

In a preferred form it is contemplated to employ as a class (ii) dopant a hexacoordination complex satisfying the formula:

$$[IrL^1_6]^{n'} \quad \text{(II)}$$

wherein n' is zero, −1, −2, −3, or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(\text{thiazole})]^{-2}$
(ii-2) $[IrCl_4(\text{thiazole})_2]^{-1}$
(ii-3) $[IrBr_5(\text{thiazole})]^{-2}$
(ii-4) $[IrBr_4(\text{thiazole})_2]^{-1}$
(ii-5) $[IrCl_5(\text{5-methylthiazole})]^{-2}$
(ii-6) $[IrCl_4(\text{5-methylthiazole})_2]^{-1}$
(ii-7) $[IrBr_5(\text{5-methylthiazole})]^{-2}$
(ii-8) $[IrBr_4(\text{5-methylthiazole})_2]^{-1}$ It is well known in the art that dopants may be employed to reduce the photographic sensitivity of an emulsion. In particular, doping at levels much greater than those that may typically be employed to optimize many photographic responses may result is large sensitivity losses. However, often these highly doped and highly desensitized emulsions suffer from other deleterious features, such as fog increase, latent image instability, contrast loss or gain, and other departures from ideal sensitometric curve shape. These effects may, for instance, result in unacceptable tone reproduction in imaging systems employing these emulsions.

As disclosed by Olm et al in U.S. Pat. No. 5,360,712, a class of cobalt coordination complexes was contemplated as dopants in photographic emulsions to reduce photographic speed with minimal (<5%) or no alteration in photographic contrast. Potassium tetracyano(ethylenediamine) cobaltate (III) was exemplified for this purpose. We prefer employing the (N-methylpyrazinium)$IrCl_5$(N-methylpyrazinium) dopant, to afford a similar result within the context of the invention.

In one preferred aspect of the invention, it is contemplated to use a layer with a magenta dye forming coupler, a class (ii) dopant in combination with an $OsCl_5(NO)$ dopant.

Suitable emulsions can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver, and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image formers and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with comer epitaxy are illustrated by Maskasky U.S. Pat. No. 5,275,930. For the purpose of providing a clear demarcation, the term "silver halide grain" is herein employed to include the silver necessary to form the grain up to the point that the final {I 100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

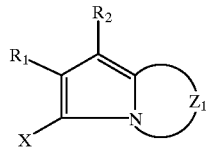

CYAN-2

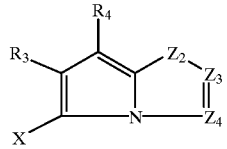

CYAN-3

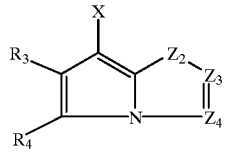

CYAN-4

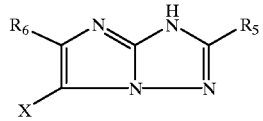

wherein $R_1$, $R_5$and $R_8$ each represents a hydrogen or a substituent; $R_2$ represents a substituent; $R_3$, $R_4$ and $R_7$ each represents an electron attractive group having a Hammett's substituent constant apara of 0.2 or more and the sum of the $\sigma_{para}$ values of $R_3$ and $R_4$ is 0.65 or more; $R_6$ represents an electron attractive group having a Hammett's substituent constant apara of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)= and —N=; and $Z_3$ and $Z_4$ each represents —C($R_8$)= and —N=.

Even more preferable are cyan couplers of the following formulas:

CYAN-5

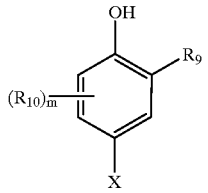

CYAN-6

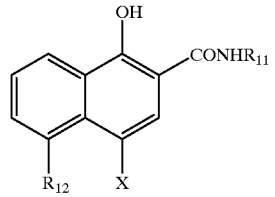

wherein $R_9$ represents a substituent (preferably a carbamoyl, ureido, or carbonamido group); $R_{10}$ represents a substituent (preferably individually selected from halogens, alkyl, and carbonamido groups); $R_{11}$ represents ballast substituent; $R_{12}$ represents a hydrogen or a substituent (preferably a carbonamido or sulphonamido group); X represents a hydrogen or a coupling-off group; and m is from 1–3.

A dissociative group has an acidic proton, e.g. —NH—, —CH(R)—, etc., that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

Another type of preferred cyan coupler is an "NB coupler" which is a dye-forming coupler which is capable of coupling with the developer 4-amino-3-methyl-N-ethyl-N-(2-methanesulfonamidoethyl)aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

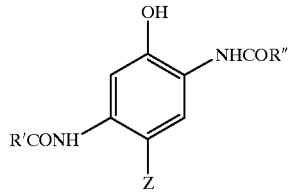

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

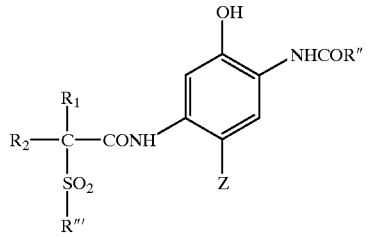

wherein

R" and R'" are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R'" is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima $\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom, then the other is preferably an alkyl group having 1 to 4 carbon atoms, more preferably 1 to 3 carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (1), R" is suitably an unsubstituted or substituted amino, alkyl or aryl group or a 5- to 10-membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula (I) when R'" is alkyl, it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular, each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecylphenoxy; an alkyl- or aryl-acyloxy group such as acetoxy or dodecanoyloxy; an alkyl- or aryl-acylamino group such as acetamido, hexadecanamido or benzaamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA), Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A. Halogen, alkoxy, and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

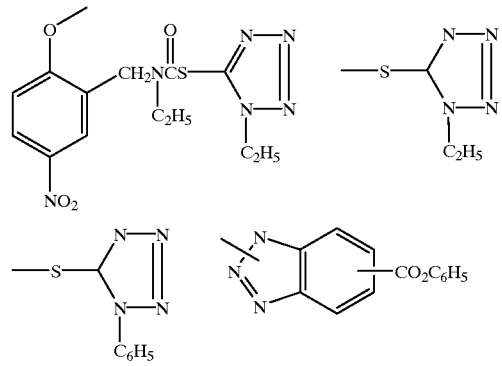

-continued

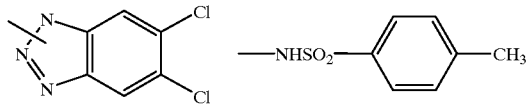

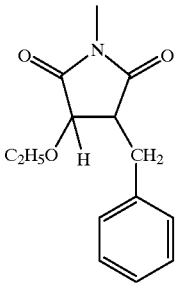

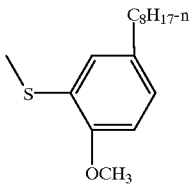

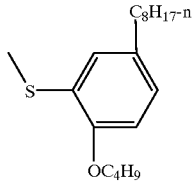

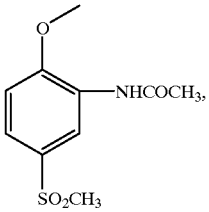

and

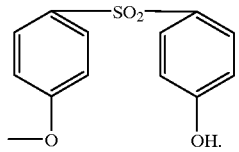

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast, it is often necessary to ballast the other substituents as well, since Z is eliminated from the molecule upon coupling; thus, the ballast is most advantageously provided as part of groups other than Z.

The following examples further illustrate preferred cyan couplers to be used with the invention. It is not to be construed that the present invention is limited to these examples.

C-1

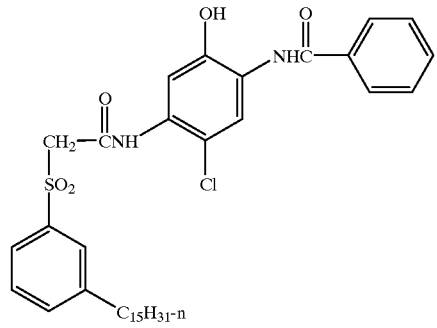

C-2

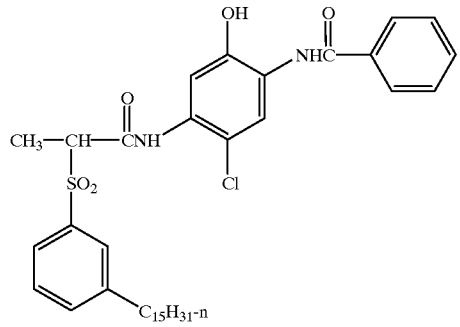

C-3

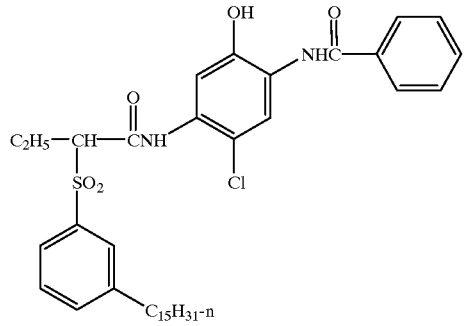

C-4

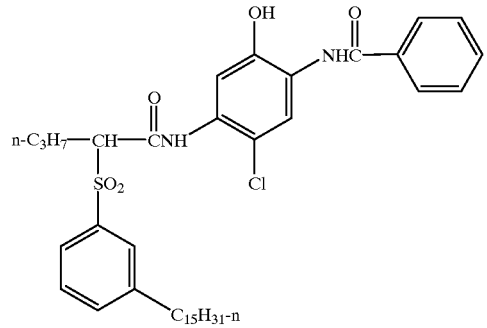

-continued
C-5
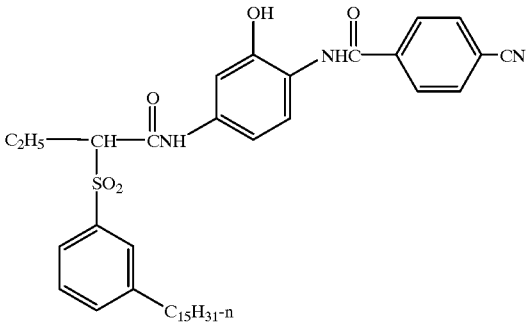
C-6
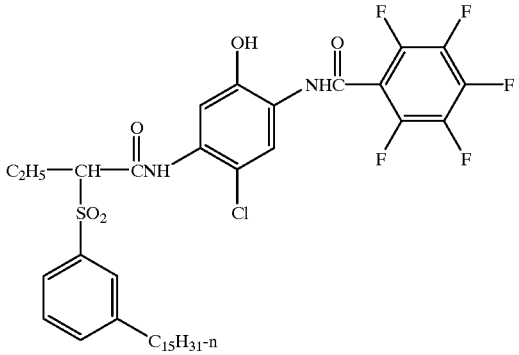
C-7
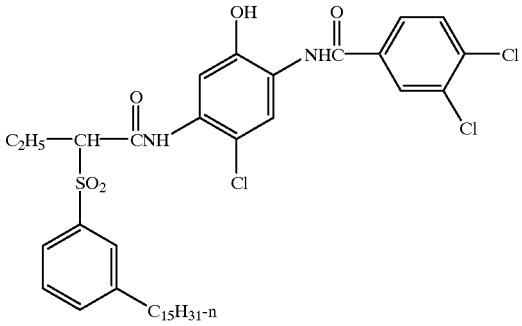
C-8
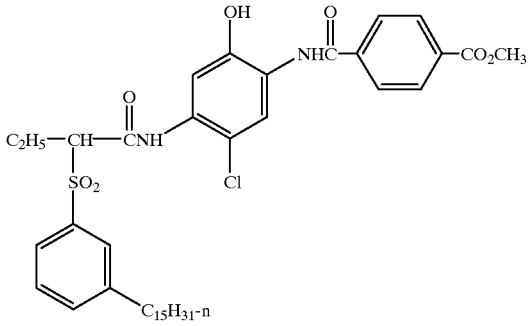
-continued
C-9
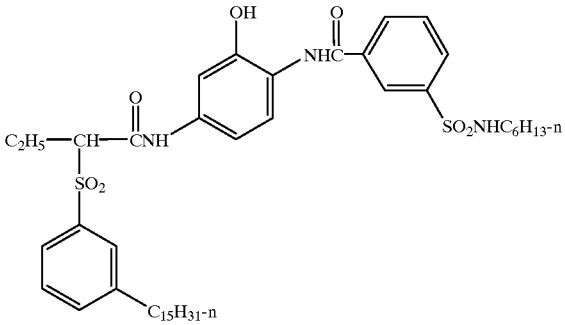
C-10
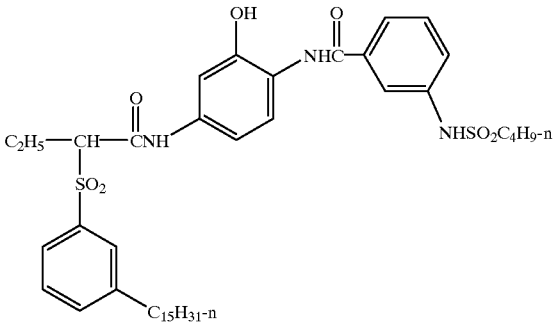
C-11
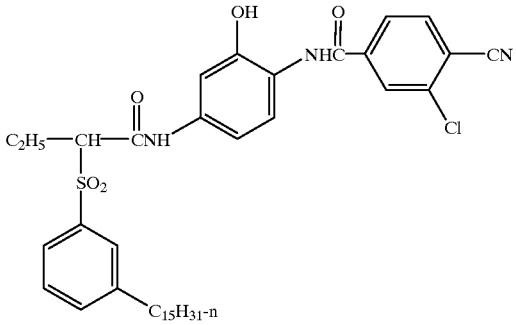
C-12
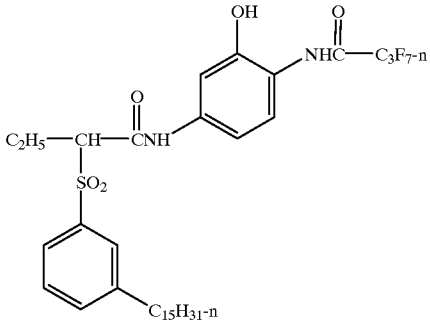

-continued
C-13
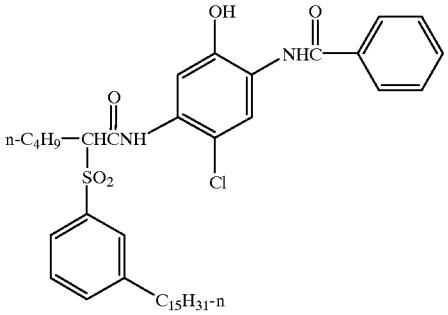
C-14
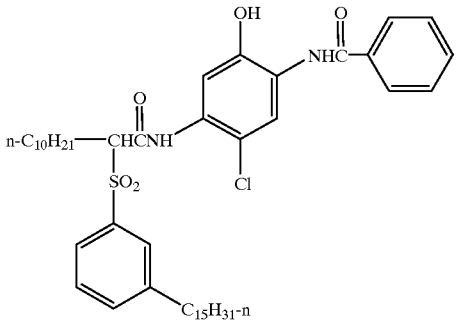
C-15
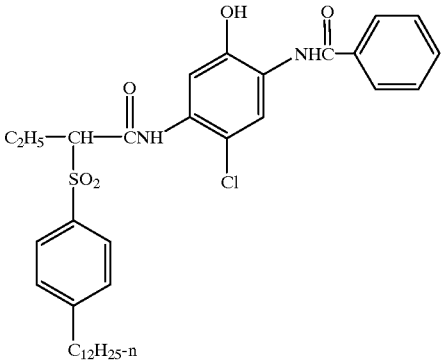
C-16
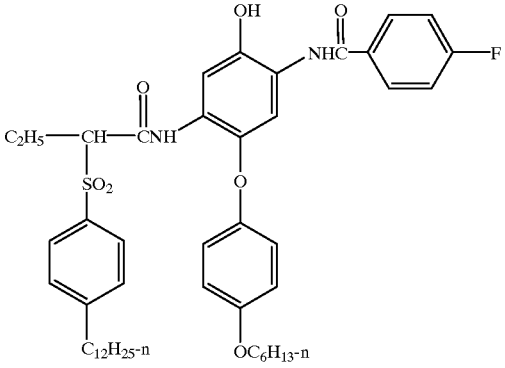
-continued
C-17
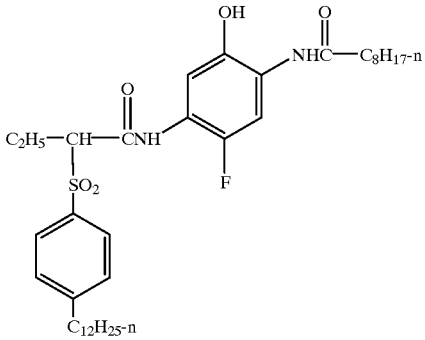
C-18
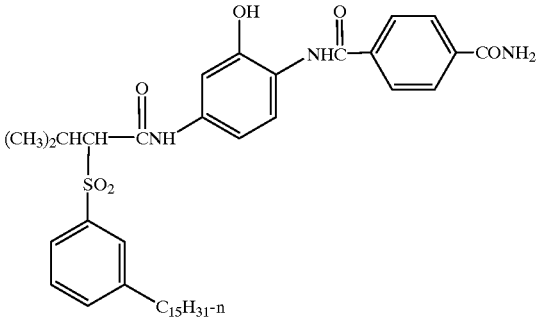
C-19
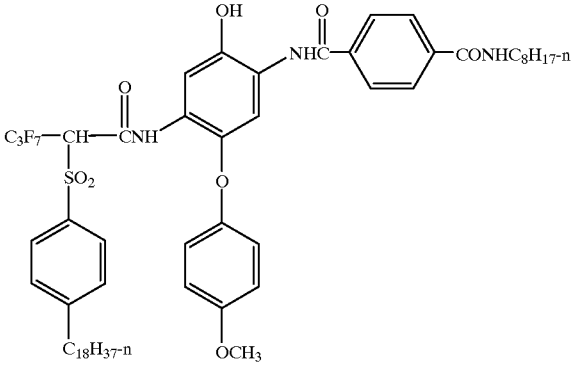
C-20
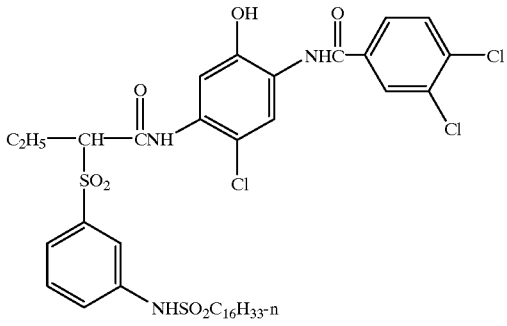

-continued
C-21
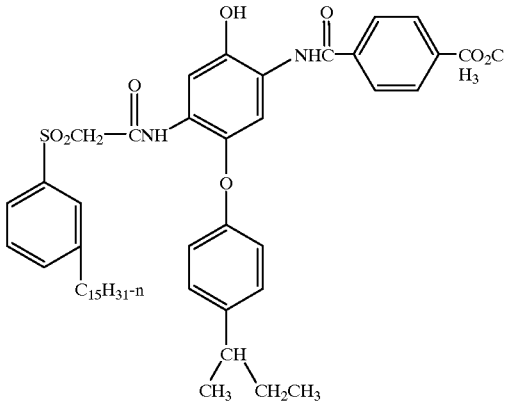
C-22
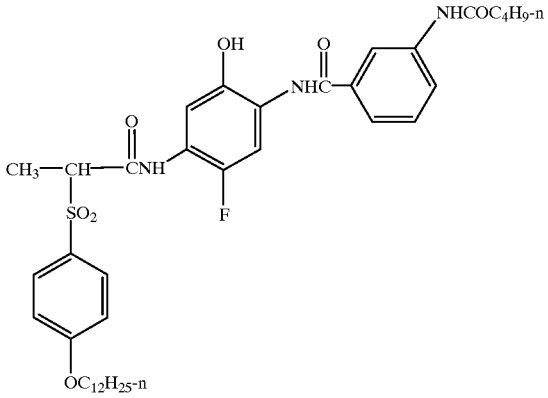
C-23
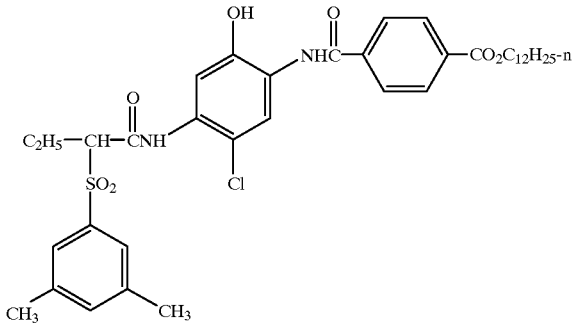
C-24
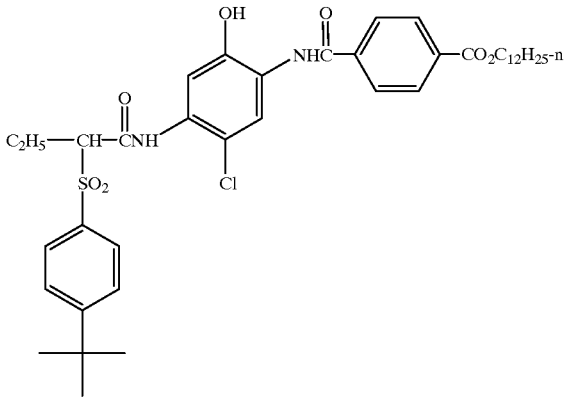
-continued
C-25
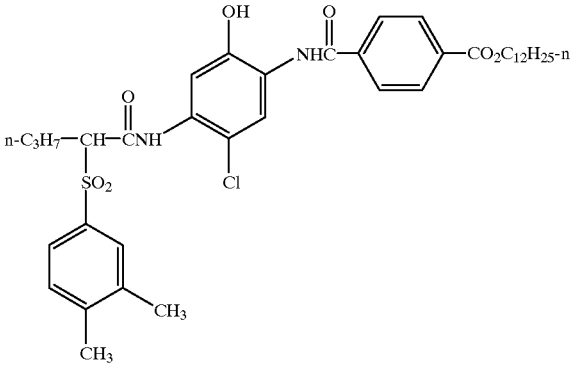
C-26
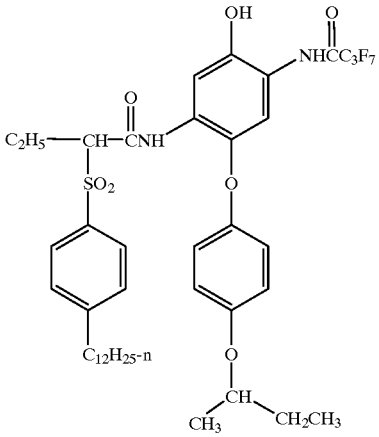
C-27
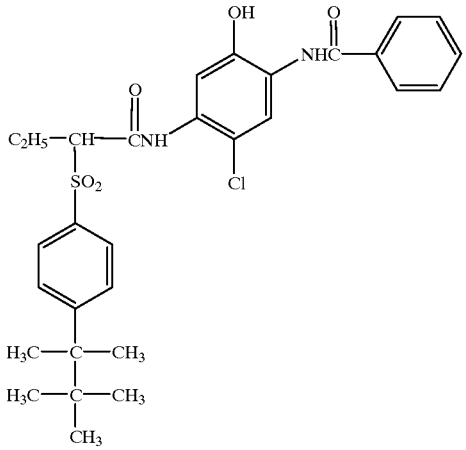

-continued
C-28
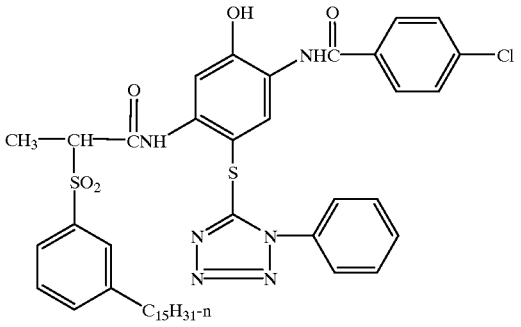
C-29
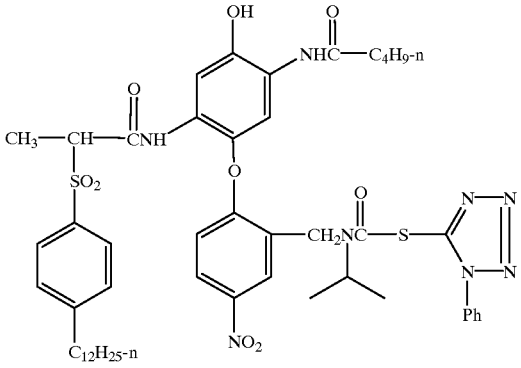
C-30
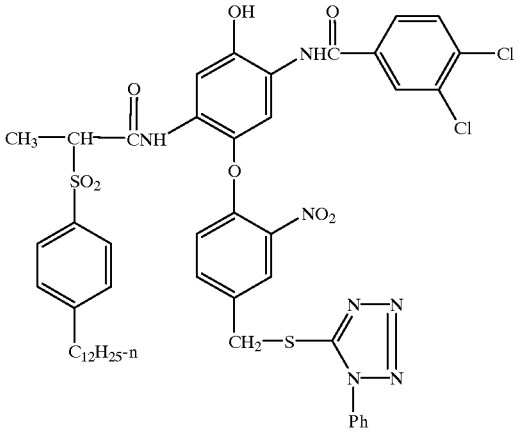
-continued
C-31
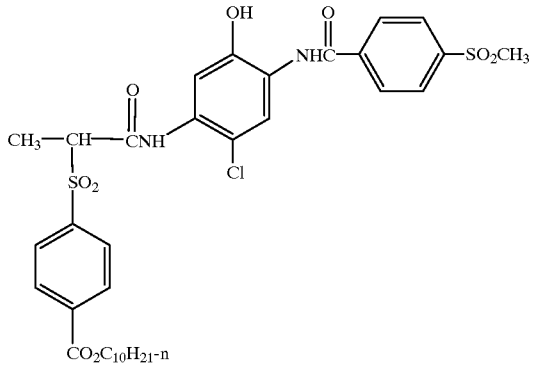
C-32
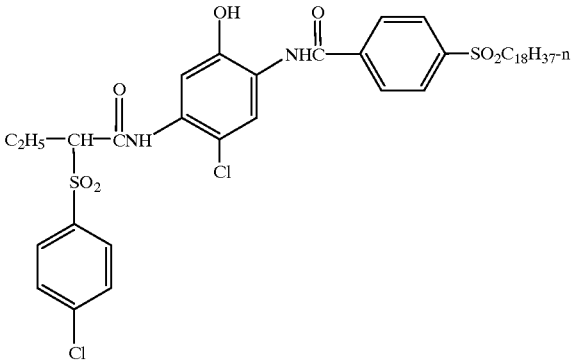
C-33
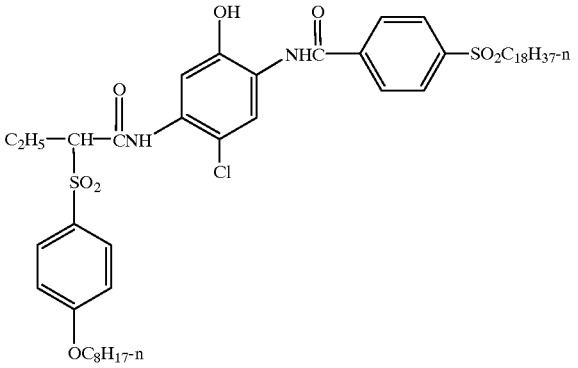
C-34
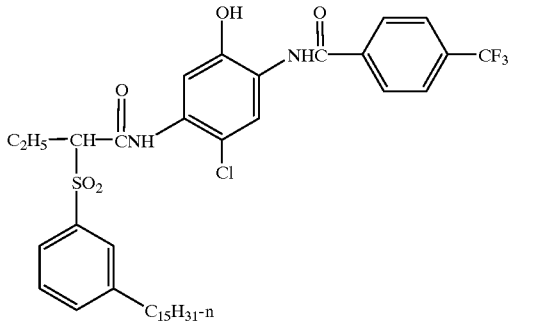

-continued

C-35

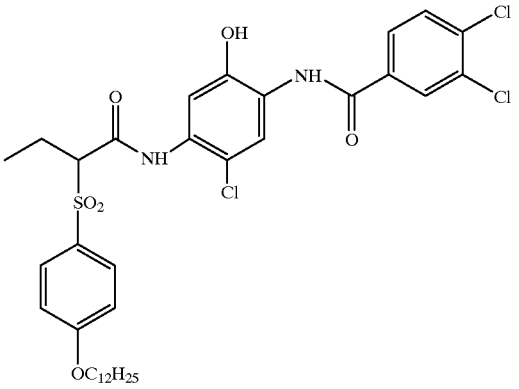

C-36

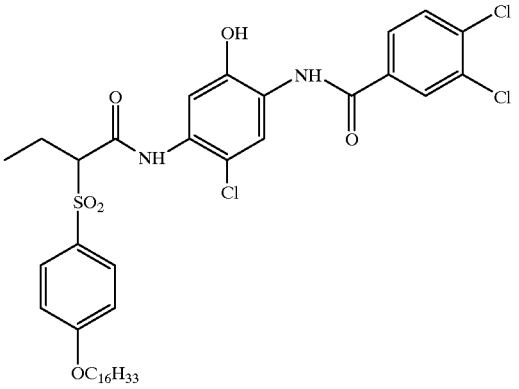

C-37

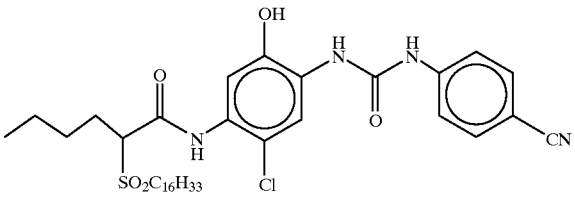

C-38

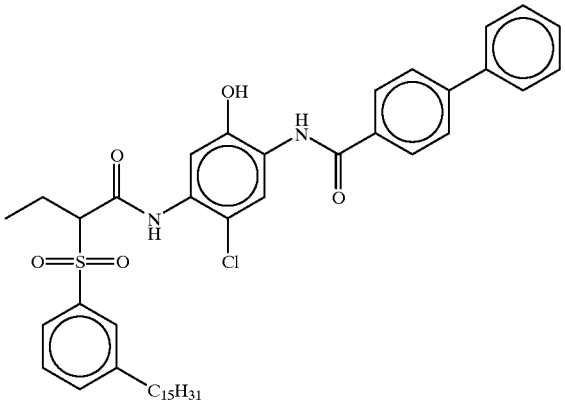

-continued

C-39

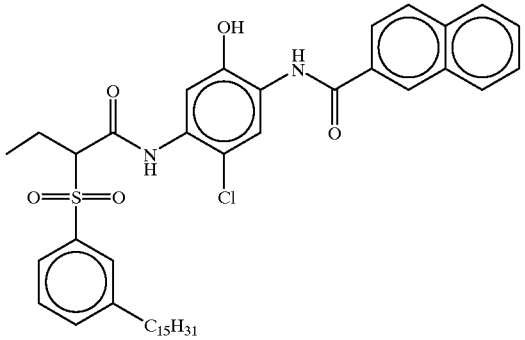

C-40

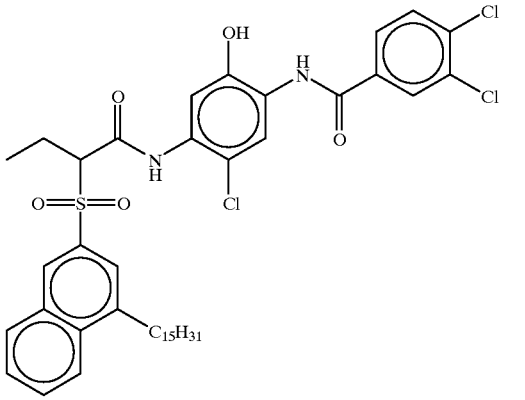

Preferred couplers are C-3, C-7, C-35, and C-36 because of their suitably narrow left bandwidths.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; and "Farbkupplereine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

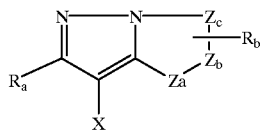

-continued

MAGENTA-2

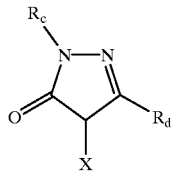

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

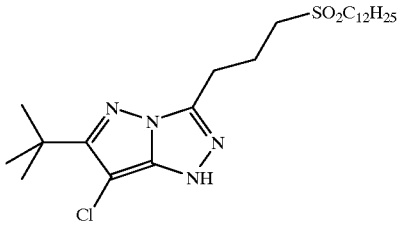

M-2

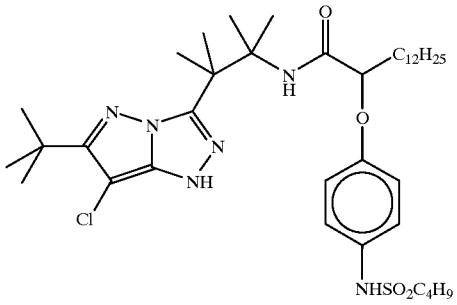

M-3

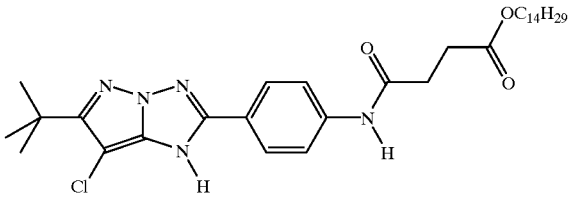

M-4

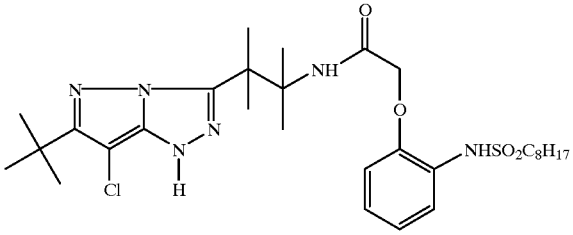

-continued

M-5

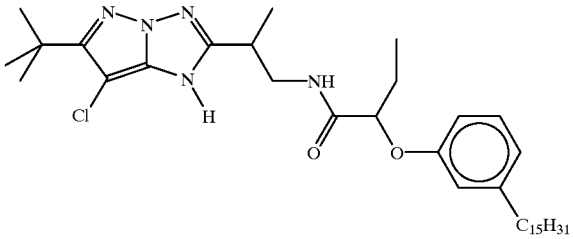

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

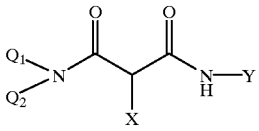

YELLOW-2

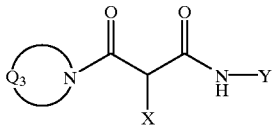

YELLOW-3

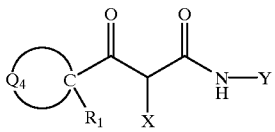

YELLOW-4

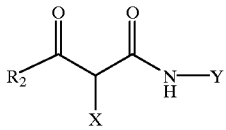

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Preferred yellow couplers can be of the following general structures:

Y-1

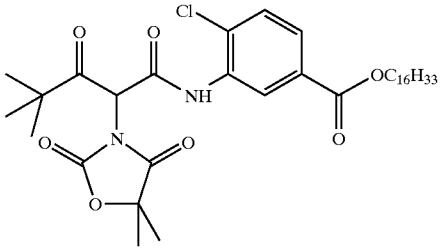

Y-2

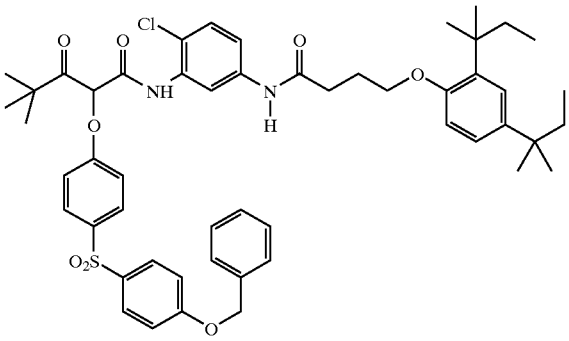

Y-3

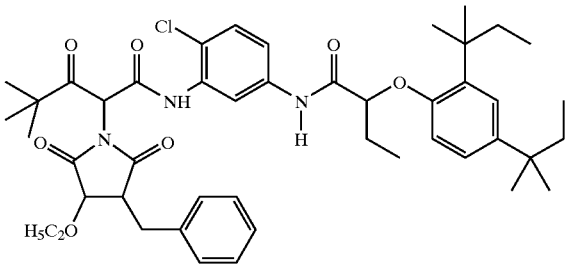

Y-4

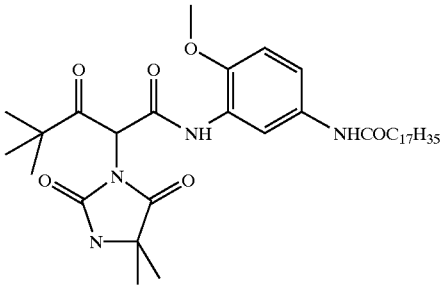

-continued

Y-5

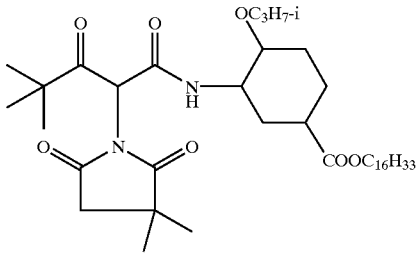

Y-6

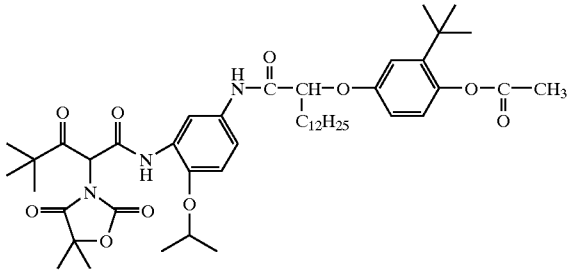

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfaimoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbatrroyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, andp-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, andp-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Stabilizers and scavengers that can be used in these photographic elements, but are not limited to, the following:

ST-1

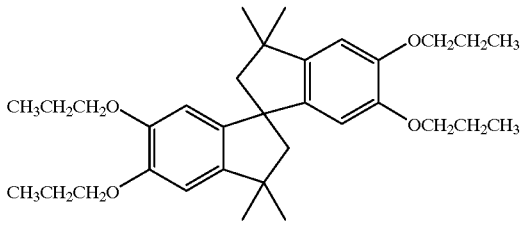

ST-2

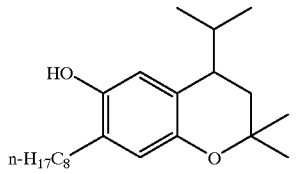

ST-3

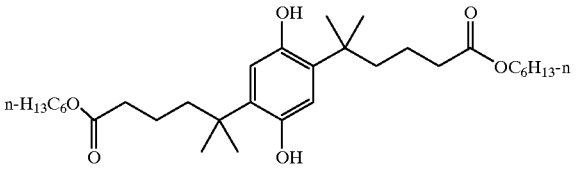

ST-4

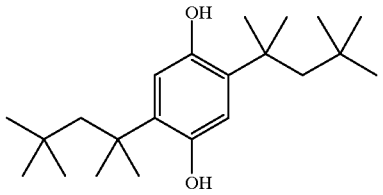

ST-5

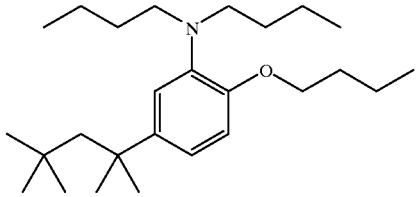

ST-6

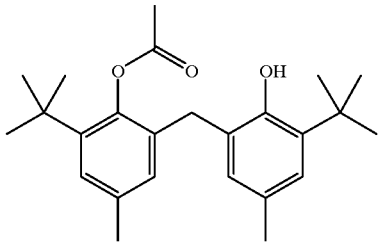

ST-7

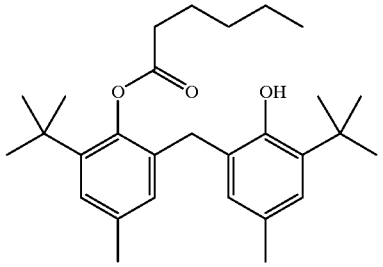

-continued
ST-8
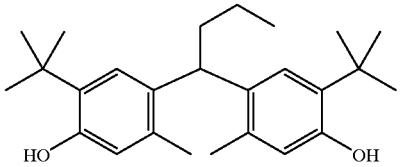
ST-9
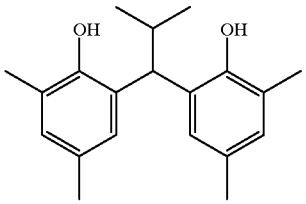
ST-10
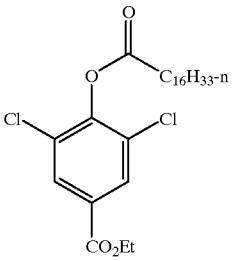
ST-11
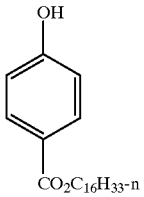
ST-12
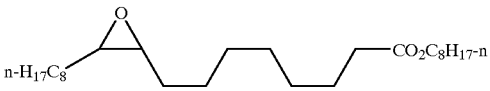
ST-13
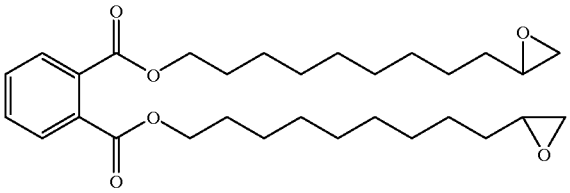
-continued
ST-14
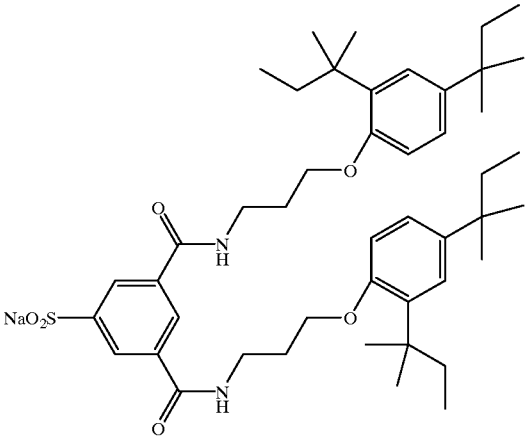
ST-15
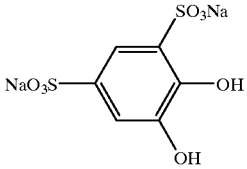
ST-16
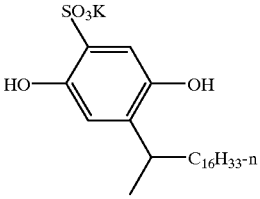
ST-17
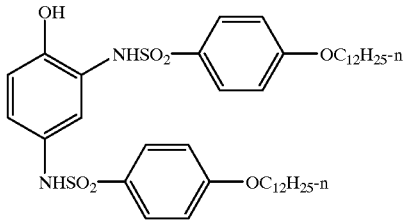
ST-18
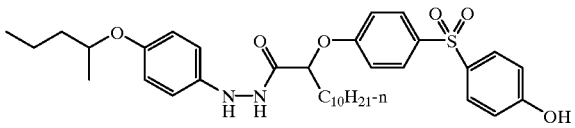
ST-19
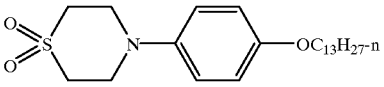
ST-20
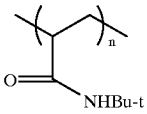
n = 75–8,000

-continued

ST-21

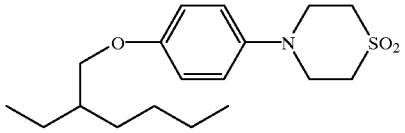

ST-22

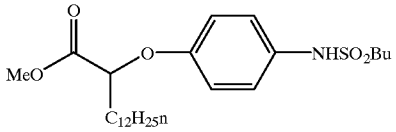

ST-23

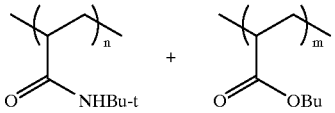

n:m 1:1 mw = 75–100,000

ST-24

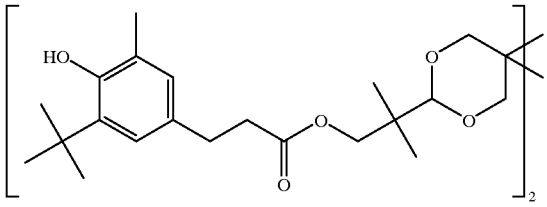

Examples of solvents which may be used in the invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |

The dispersions used in photographic elements may also include ultraviolet (UV) stabilizers and so-called liquid UV stabilizers such as described in U.S. Pat. Nos. 4,992,358; 4,975,360; and 4,587,346. Examples of UV stabilizers are shown below.

UV-1

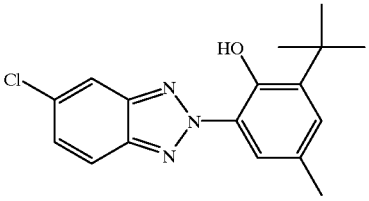

-continued

UV-2

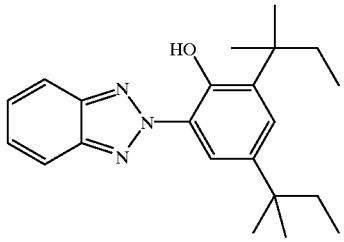

UV-3

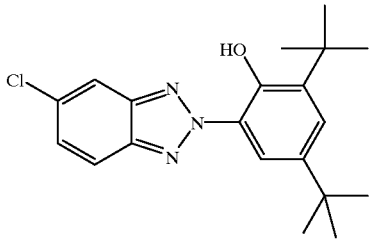

UV-4

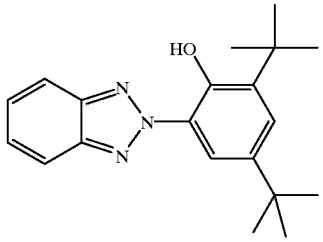

UV-5

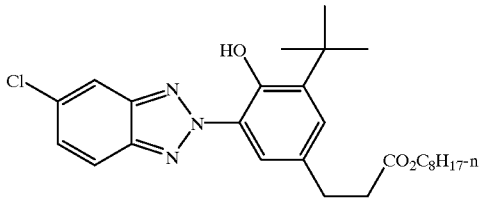

UV-6

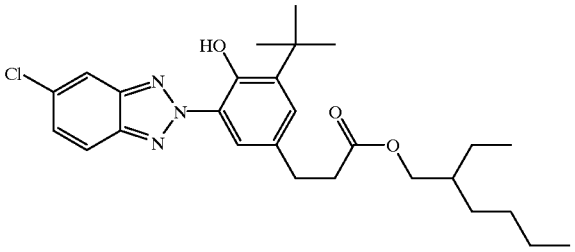

UV-7

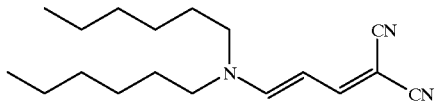

UV-8

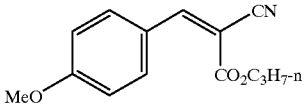

The aqueous phase may include surfactants. Surfactant may be cationic, anionic, zwitterionic or non-ionic. Useful surfactants include, but are not limited to, the following:

SF-1

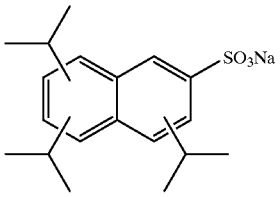

SF-2

$CF_3 \cdot (CF_2)_7 \cdot SO_3Na$

SF-3

$CH_3 \cdot (CH_2)_n \cdot SO_3Na$, n = 12–14

SF-4

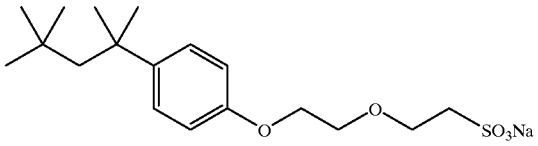

SF-5

$CH_3 \cdot (CH_2)_{11} \cdot OSO_3Na$

SF-6

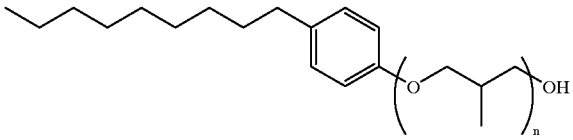

n = ca•10

SF-7

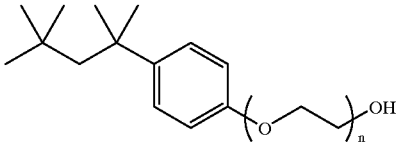

n = ca•40

SF-8

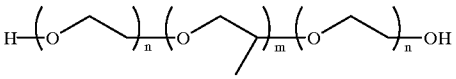

n = ca•6, m = ca•2

SF-9

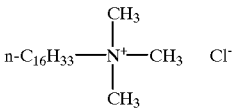

SF-10

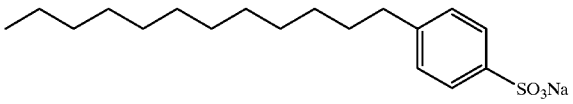

SF-11

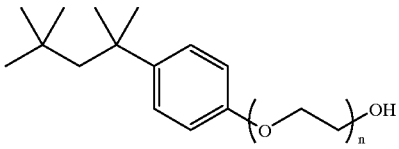

n = ca•10

-continued

SF-12

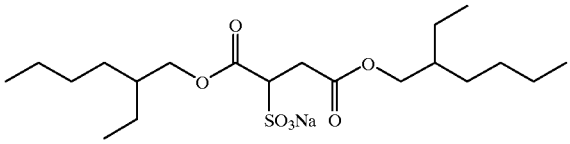

Further, it is contemplated to stabilize photographic dispersions prone to particle growth through the use of hydrophobic, photographically inert compounds such as disclosed by Zengerle et al U.S. Pat. No. 5,468,604.

In a preferred embodiment the invention employs recording elements which are constructed to contain at least six silver halide emulsion layer units. A suitable full color, mrultilayer format for a recording element used in the invention is represented by Structure I.

| STRUCTURE I |
|---|
| Red-sensitized cyan dye image-forming silver halide emulsion unit |
| Interlayer |
| Green-sensitized magenta dye image-forming silver halide emulsion unit |
| Interlayer |
| Blue-sensitized yellow dye image-forming silver halide emulsion unit |
| ///// Support ///// |
| Blue-sensitized yellow dye image-forming silver halide emulsion unit |
| Interlayer |
| Green-sensitized magenta dye image-forming silver halide emulsion unit |
| Interlayer |
| Red-sensitized cyan dye image-forming silver halide emulsion unit |

The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include structures as described in U.S. Pat. No. 5,783,373. Each of such structures in accordance with the invention preferably would contain at least six silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

Conventional features that can be incorporated into multilayer (and particularly multicolor) recording elements contemplated for use in the method of the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18, and 23.

It has been observed that anionic $[MX_xY_yL_z]$ hexacoordination complexes, where M is a group 8 or 9 metal (preferably iron, ruthenium or iridium), X is halide or pseudohalide (preferably Cl, Br or CN) x is 3 to 5, Y is $H_2O$, y is O or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in in improving latent image keeping (LIK). As herein employed HIRF is a measure of the variance of photographic properties for equal exposures, but with exposure times ranging from $10^{-1}$ to $10^{-6}$ second. LIRF is a measure of the variance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably >90 mole %) chloride emulsions. Preferred C—C, H—C or C—N—H organic ligands are aromatic heterocycles of the type described in U.S. Pat. No. 5,462,849. The most effective C—C, H—C or C—N—H organic ligands are azoles and azines, either unsustituted or containing alkyl, alkoxy, or halide substituents, where the alkyl moieties contain from 1 to 8 carbon atoms. Particularly preferred azoles and azines include thiazoles, thiazolines and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm and often from $10^{-3}$ ergs/cm to $10^{-2}$ ergs/cm. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^{-4}$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235 and European Patent Applications 479 167 A1 and 502 508 A1.

Once imagewise exposed, the recording elements can be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing and stabilizing

In addition, a useful developer for the inventive material is a homogeneous, single part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097 A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-p-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described, for example, in U.S. Pat. Nos. 4,892,804; 4,876,174; 5,354,646; and 5,660,974, all noted above, and U.S. Pat. No. 5,646,327 (Bums et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

More preferably, the noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al), as having the structure AI:

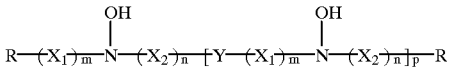

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure AI, m, n, and p are independently 0 or 1. Preferably, each of m and n is 1, and p is 0.

Specific di-substituted hydroxylamine antioxidants include, but are not limited to, N,N-bis,(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, morphology |
| 2 | I, II, IX, X, XI, XII, XIV, XV | and preparation. Emulsion preparation including hardeners, |
| 3 | I, II, III, IX A & B | coating aids, addenda, etc. |
| 1 | III, IV | Chemical sensitization and |
| 2 | III, IV | spectral sensitization/ |
| 3 | IV, V | Desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultaviolet, visible, and infrared regions of the electromagnetic spectrum as well as with electron beam, beta radiation, gamma radiation, x-ray alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The preferred reflective/transmission display materials of this invention wherein said imaging element comprises at least one dye forming layer comprising silver halide and dye forming coupler on the opposite side of said transparent polymer sheet from the biaxially oriented polyolefin sheet and said exposure of both coupler containing layers is from the side of said imaging element having the biaxially oriented polyolefin sheet is preferred. This allows for traditional image processing equipment to be used. The imaging elements of this invention can be exposed via traditional optical methods using a negative, but they are preferably exposed by means of a collimated beam, to form a latent image, and then processed to form a visible image, preferably by other than heat treatment. A collimated beam is preferred as it allows for digital printing and simultaneous exposure of the imaging layer on the top and bottom side without significant internal light scatter. A preferred example of a collimated beam is a laser also known as light amplification by stimulated emission of radiation. The laser is preferred because this technology is used widely in a number of digital printing equipment types. Further, the laser provides sufficient energy to simultaneously expose the light sensitive silver halide coating on the top and bottom side of the display material of this invention without undesirable light scatter. Subsequent processing of the latent image into a visible image is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Silver Halide Emulsion Preparation

Silver chloride emulsions used in the photographic examples were chemically and spectrally sensitized as described below.

Emulsion EB-1

To a reactor incorporating a stirring device as disclosed in Research Disclosure, Item 38213, and containing 8.756 kg of distilled water, 25 mg of p-glutaramidophenyl disulfide and 251 g of bone gelatin were added to 291 g of 3.8 M sodium chloride salt solution such that the mixture was maintained at a pCl of about 1.05 at approximately 68° C. To this were added 1.9 of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 74 mL/min for about 39 min. while maintaining pCl constant at about 1.05. Both the silver and sodium salt solution pumps were then turned off, and about 0.8 M potassium iodide solution was added to the stirred reaction mixture over about 30 seconds at a constant flow rate of about 62.9 mL/min. The resultant iodochloride emulsion was then grown further by conventional controlled double-jet addition for about 4.5 min. by resumed addition of silver and sodium salt solutions at about 74 mL/min. at a pCl of about 1.05. In addition, cesium pentachloronitrosylosmate was added at approximately 4 to 70% into the precipitation, potassium hexacyanoruthenate at 75 to 80%, and iridium pentachloro-5-methylthiazole was added at 95 to 98% band after iodide addition. A silver iodochloride emulsion was thus prepared with 0.2 mole % iodide located at 90% of total grain volume. Cubic edge length was 0.64 μm.

A portion of this silver iodochloride emulsion was optimally sensitized by the addition of p-glutaramidophenyl disulfide followed by the addition of a colloidal suspension of aurous sulfide and heat ramped to 60° C., during which time blue sensitizing dye (BSD-1), potassium hexachloroiridate, Lippmann bromide, and 1-(3-acetamidophenyl)-5-mercaptotetrazole were added.

Emulsion EB-2

A portion of this silver iodochloride emulsion was spectrally sensitized by heating to 60° C., during which time blue sensitizing dye (BSD-1) followed by 1-(3-acetamidophenyl)-5-mercaptotetrazole were added.

Emulsion EB-3

Emulsion in this example was precipitated as for EB-1 above, except that the flow of the reagents during nucleation was increased to 200 mL/min, and AgI seeds were used in place of iodide in the amount of 0.5% of total silver. The resultant emulsion's grain size was 0.42 μm.

A portion of this silver iodochloride emulsion was optimally sensitized by the addition of p-glutaramidophenyl disulfide followed by the addition of a colloidal suspension of aurous sulfide and heat ramped to 60° C., during which time blue sensitizing dye (BSD-1), potassium hexachloroiridate, Lippmann bromide, and 1-(3-acetamidophenyl)-5-mercaptotetrazole were added.

Emulsion EB-4

To a reactor incorporating a stirring device as disclosed in *Research Disclosure*, Item 38213, and containing 8.921 grams of distilled water, 25 milligrams of p-glutaramidophenyldisulfide and 250 grams of bone gelatin were added to 294 grams of 3.8 M sodium chloride salt solution such that the mixture was maintained at a pCl of about 1.05 at approximately 68° C. To this were added 1.9 grams of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 104.4 milliliters/minute for about 1.28 minutes while maintaining pCl constant at about 1.05. A 1.0 min. rest period followed nucleation. The remainder of the silver nitrate and sodium chloride for growth of 91% of the core of the grain was delivered with five double-jet pulses at the flow rate of about 234 milliliters/minute separated by hold periods. The duration of the pulses were 0.75, 0.75, 3.0, 5.03, and 3.0 minutes, respectively. There was a period of rest after each successive pulse. The duration of rests were 5, 3, 3, 3, and 2 minutes, respectively. Both the silver nitrate and sodium chloride solution pumps were then turned off, and about 0.8 M potassium iodide solution was added to the stirred reaction mixture over about 0.5 min. at a constant flow rate of about 62.5 milliliters/min. Following a 0.5 min. rest period, the resultant iodochloride emulsion was then grown further by pulsed controlled double-jet addition for about 1.3 min. by resumed addition of silver and sodium salt solutions at about 226 mL/min. at a pCl of about 1.05. The solution was then held for one min. The stirring speed of the stirring device was maintained at 2250 revolutions per minute (RPM) during the entire precipitation process. In addition, $Cs_2Os(NO)Cl_5$was added at approximately 35 to 71%, and $K_4Ru(CN)_6$ at approximately 75 to 80% into the precipitation. A 2 N NaCl solution containing 0.9 milligrams of $K_2IrCl_5$(5-methylthiazole) and 0.074 milligrams of (N-methylpyrazinium)$IrCl_5$(N-methylpyrazinium) was added at 85 to 88% of the grain volume. A total of 12.5 moles of a silver iododchloride emulsion was thus prepared with 0.2 mole % iodide added at 91% of total grain volume. Cubic edge length was 0.61 μm.

A portion of this silver iododchloride emulsion was optimally sensitized by the addition of p-glutaramidophenyl disulfide followed by the addition of a colloidal suspension of aurous sulfide and heat ramped to 60° C., after which time blue sensitizing dye (BSD-1), $K_2IrCl_6$, Lippmann bromide, and 1-(3-acetamidophenyl)-5-mercaptotetrazole were added.

Emulsion EB-5

Emulsion EB-5 was prepared exactly as Emulsion EB4 except that (N-methylpyrazinium)$IrCl_5$(N-methylpyrazinium) was omitted.

Emulsion EB-6

Emulsion EB-6 was prepared exactly as Emulsion EB-4 except that the amount of (N-methylpyrazinium)$IrCl_5$(N-methylpyrazinium) was reduced to 0.037 milligrams.

Emulsion EB-7

Emulsion EB-7 was prepared exactly as Emulsion EB-4 except that the amount of (N-methylpyrazinium)$IrCl_5$(N-methylpyrazinium) was increased to 0.148 milligrams.

Emulsion EB-8

Emulsion EB-8 was prepared exactly as Emulsion EB-4 except that the amount of (N-methylpyrazinium)$IrCl_5$(N-methylpyrazinium) was increased to 0.148 milligrams, and the 2 N NaCl solution containing this dopant was added at 60 to 62% of grain formation.

Emulsion EB-9

Emulsion EB-9 was prepared exactly as Emulsion EB-4 except that the amount of (N-methylpyrazinium)$IrCl_5$(N-methylpyrazinium) was increased to 0.148 milligrams, and the 2 N NaCl solution containing this dopant was added at 88.25 to 90.5% of grain formation.

Emulsion EB-10

Emulsion EB-10 was prepared exactly as Emulsion EB-4 except that the amount of (N-methylpyrazinium)$IrCl_5$(N-methylpyrazinium) was increased to 0.148 milligrams, and the 2 N NaCl solution containing this dopant was added at 94 to 96% of grain formation.

Emulsion EG-1

A reaction vessel contained 5.0 L of a solution that was 6.9% in regular gelatin and contained 1.80 g of a Pluronic™ antifoam agent. To this stirred solution at 58° C., 74.4 g of 2.8 M NaCl was dumped. A half min. after addition of NaCl solution, 70 mL of a 2.6 M $AgNO_3$ solution, and 77.6 mL of 2.8 M NaCl were added simultaneously at 35 mL/min. The vAg set point was chosen equal to that observed in the reactor at this time. The 2.6 M silver nitrate solution and the 2.8 M sodium chloride solution were added simultaneously with a ramped linearly increasing flow from 35 mL/min. to 123 mL/min. over 18 min. To this, 2.6 M silver nitrate solution and the 2.8 M sodium chloride solution were added simultaneously with a constant flow at 123 mL/min. over 23.7 min. During precipitation, 1.6 micrograms per silver mole of cesium pentachloronitrosylosmate ($Cs_2$(II)Os[NO]$Cl_5$) was added during to 3.5 to 70% of grain formation, and 0.52 milligrams per silver mole of $K_2IrCl_5$(5-methylthiazole) was added during to 90 to 95% of grain formation. The resulting silver chloride emulsion had a cubic shape that was 0.35 $\mu$m in edge length. The emulsion was then washed using an ultrafiltration unit, and its final pH and pCl were adjusted to 5.6 and 1.8, respectively.

A portion of this silver chloride emulsion was optimally sensitized by the addition of green sensitizing dye GSD-1, followed by the addition of a colloidal suspension of aurous sulfide and heat ramped to 60° C., and then held for 34 min. After cooling emulsion to 40° C. 1-(3-acetamidophenyl)-5-mercaptotetrazole, potassium bromide and potassium chloride were added.

Emulsion EG-2

A reaction vessel contained 6.74 L of a solution that was 4.12% in regular gelatin and contained 1.71 g of a Pluronic™ antifoam agent. To this stirred solution at 46.1° C., 94.9 mL of 3.0 M NaCl was dumped, and soon after 20.75 mL of dithiaoctanediol solution was poured into the reactor. A half min. after addition of dithiaoctanediol solution, 164.6 mL of a 2.8 M $AgNO_3$ solution and 165.8 mL of 3.0 M NaCl were added simultaneously at 186.4 mL/min. for 0.88 min. The vAg set point was chosen equal to that observed in the reactor at this time. Then the 2.8 M silver nitrate solution and the 3.0 M sodium chloride solution were added simultaneously with a constant flow at 186.4 mL/min. over 16.34 min. During precipitation, 1.5 micrograms per silver mole of cesium pentachloronitrosylosmate (Cs2(II)Os[NO]$Cl_5$) was added during to 3.5 to 70% of grain formation, and 0.554 milligrams per silver mole of $K_2IrCl_5$(5-methylthiazole) was added during to 90 to 95% of grain formation. The resulting silver chloride emulsion had a cubic shape that was 0.30 $\mu$m in edge length. The emulsion was then washed using an ultrafiltration unit, and its final pH and pCl were adjusted to 5.6 and 1.8, respectively.

A portion of this silver chloride emulsion was optimally sensitized by the addition of p-glutaramidophenyl disulfide followed by the addition of a colloidal suspension of aurous sulfide and heat ramped to 55° C. during which time, Lippmann bromide doped with potassium hexachloroiridate, green sensitizing dye GSD-1 and 1-(3-acetamidophenyl)-5-mercaptotetrazole were added.

Emulsion EG-3

A reaction vessel contained 6.74 L of a solution that was 4.12% in regular gelatin and contained 1.71 g of a Pluronic™ antifoam agent. To this stirred solution at 46.1° C., 94.9 mL of 3.0 M NaCl was dumped, and soon after 6.22 mL of dithiaoctanediol solution was poured into the reactor. A half min after addition of dithiaoctanediol solution, 164.6 mL of a 2.8 M $AgNO_3$ solution and 165.8 mL of 3.0 M NaCl were added simultaneously at 186.4 mL/min for 0.88 min. The vAg set point was chosen equal to that observed in the reactor at this time. Then the 2.8 M silver nitrate solution and the 3.0 M sodium chloride solution were added simultaneously with a constant flow at 186.4 mL/min over 16.34 min. During precipitation, 2.03 milligrams per silver mole of $K_2IrCl_5$(5-methylthiazole) was added during to 90 to 95% of grain formation. The resulting silver chloride emulsion had a cubic shape that was 0.18 $\mu$m in edge length. The emulsion was then washed using an ultrafiltration unit, and its final pH and pCl were adjusted to 5.6 and 1.8, respectively.

A portion of this silver chloride emulsion was optimally sensitized by the addition of green sensitizing dye GSD-1 followed by the addition of a colloidal suspension of aurous sulfide and heat ramped to 60° C. during which time, Lippmann bromide, and 1-(3acetamidophenyl)-5-mercaptotetrazole were added.

Emulsion ER-1

A reaction vessel contained 6.92 L of a solution that was 3.8% in regular gelatin and contained 1.71 g of a Pluronic™ antifoam agent. To this stirred solution at 46° C., 83.5 mL of 3.0 M NaCl was dumped, and soon after 28.3 mL of dithiaoctanediol solution was poured into the reactor. A half min. after addition of dithiaoctanediol solution, 104.5 mL of a 2.8 M $AgNO_3$ solution and 107.5 mL of 3.0 M NaCl were added simultaneously at 209 mL/min. for 0.5 min. The vAg set point was chosen equal to that observed in the reactor at this time. Then the 2.8 M silver nitrate solution and the 3.0 M sodium chloride solution were added simultaneously with a constant flow at 209 mL/min. over 20.75 min. During precipitation, 1.5 micrograms per silver mole of cesium pentachloronitrosylosmate (Cs(II)Os[NO]$Cl_5$) was added during to 3.5 to 70% of grain formation, and 2.20 milligrams per silver mole of $K_2IrCl_5$(5-methylthiazole) was added during to 90 to 95% of grain formation. The resulting silver chloride emulsion had a cubic shape that was 0.38 Jlm in edge length. The emulsion was then washed using an ultrafiltration unit, and its final pH and pCl were adjusted to 5.6 and 1.8, respectively.

A portion of this silver chloride emulsion was optimally sensitized by the addition of p-glutaramidophenyl disulfide followed by the addition of a sulfide and gold(I). Emulsion was then heat ramped to 65° C., during which time potassium hexachloroiridate, potassium bromide, and 1-(3-acetamidophenyl)-5-mercaptotetrazole were added. Emulsion was then cooled down to 40° C., and cyan sensitizing dye RSD-1 was added.

Emulsion ER-2

A reaction vessel contained 6.74 L of a solution that was 4.12% in regular gelatin and contained 1.71 g of a Pluronic™ antifoam agent. To this stirred solution at 46.1° C., 94.9 mL of 3.0 M NaCl was dumped, and soon after 10.38 mL of dithiaoctanediol solution was poured into the reactor. A half min. after addition of dithiaoctanediol solution, 164.6 mL of a 2.8 M $AgNO_3$ solution and 165.8 mL of 3.0 M NaCl were added simultaneously at 186.4 mL/min. for 0.88 min. The vAg set point was chosen equal to that observed in the reactor at this time. Then the 2.8 M silver nitrate solution and the 3.0 M sodium chloride solution were added simultaneously with a constant flow at 186.4 mL/min. over 16.34 min. During precipitation, 33.08 milligrams per silver mole of potassium ruthenium hexacyanide was added during to 75 to 80% of grain formation, and 4.40 milligrams per silver mole of $K_2IrCl_5$(5-methylthiazole) was added during to 90 to 95% of grain formation. The resulting silver chloride emulsion had a cubic shape that was 0.22 $\mu$m in edge length. The emulsion was then washed using an ultrafiltration unit, and its final pH and pCl were adjusted to 5.6 and 1.8, respectively.

A portion of this silver chloride emulsion was optimally sensitized by the addition of p-glutaramidophenyl disulfide followed by the addition of a sulfide and gold(I). Emulsion was then heat ramped to 65° C., during which time potassium hexachloroiridate, potassium bromide, and 1-(3-acetamidophenyl)-5-mercaptotetrazole were added. Emulsion was then cooled down to 40° C., and cyan sensitizing dye RSD-1 was added.

BSD-1

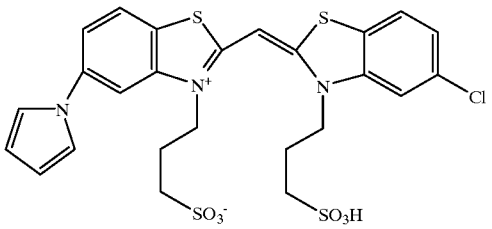

GSD-1

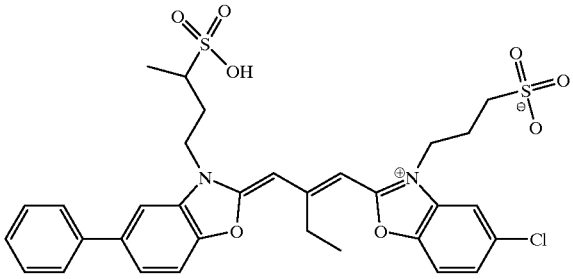

-continued

RSD-1

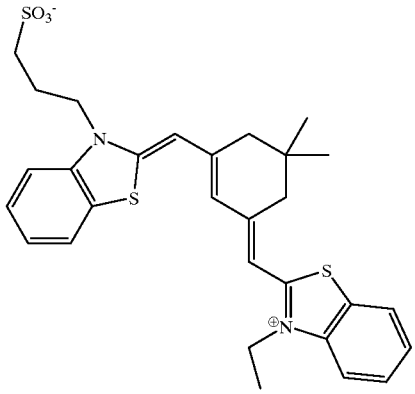

SINGLE LAYER EMULSION EXAMPLES

Emulsion Example 1

Emulsions EB-1 through EB-3 were coated on a reflective support in a conventional single layer format, exposed to light through a step tablet, and then processed using standard development chemistry and processes well known in the art for chloride emulsions. The sensitometric parameters reported below are the result of measuring the resultant densities in reflection mode. In the table below, photographic sensitivity (SPEED) is defined as the inverse logarithm of the exposure to light necessary to produce a density midway on the characteristic curve. A SPEED difference of 30 therefore corresponds to a twofold sensitivity difference (i.,e., "one stop"). SPEED is reported relative to the EB-1 comparison emulsion.

| Emulsion | Comment | Optical SPEED |
|---|---|---|
| EB-1 | Comparison | 100 |
| EB-2 | Invention | −12 |
| EB-3 | Invention | 68 |

Emulsion Example 2

Emulsions EB-4 through EB-10 were coated on a reflective support in a conventional single layer format, exposed to light through a step tablet, and processed using standard development chemistry and processes well known in the art for chloride emulsions. The sensitometric parameters reported below are the result of measuring the resultant densities in reflection mode. SPEED is reported relative to the EB-5 comparison emulsion, in which the (N-methylpyrazinium)$IrCl_5$(N-methylpyrazinium) dopant is omitted, whose speed is listed as 100.

| Emulsion | Comment | Dopant Level* | Dopant Location | SPEED |
|---|---|---|---|---|
| EB-4 | Invention | 2X | 85–88% | 40 |
| EB-5 | Comparison | None | | 100 |
| EB-6 | Invention | 1X | 85–88% | 60 |
| EB-7 | Invention | 4X | 85–88% | 22 |

-continued

| Emulsion | Comment | Dopant Level* | Dopant Location | SPEED |
|---|---|---|---|---|
| EB-8 | Invention | 4X | 60–62% | 29 |
| EB-9 | Invention | 4X | 88.25–90.5% | 28 |
| EB-10 | Invention | 4X | 94–96% | 50 |

*1X Dopant Level equals 0.00296 milligrams of (N-methylpyrazinium) $IrCl_5$(N-methylpyrazinium) per mole of silver The data in the table above show a decrease in photographic sensitivity with increasing (N-methylpyrazinium) $IrCl_5$(N-methylpyrazinium) dopant level. A preferred dopant location is evident as well, as addition of the dopant (at the 4× level) prior to the potassium iodide addition at 91% (e.,g., EB-7, EB-8, EB-9) is more effective in reducing SPEED, compared to addition after potassium iodide (e.,g., EB-10). However, any of the desensitized emulsions listed above may be employed in the invention described herein if by its use the speed difference between topside and bottom side emulsions is within the preferred range of this invention.

Emulsion Example 3

Emulsions EG-1 through EG-3 were coated on a reflective support in a conventional single layer format, given either a stepped exposure using a green laser or conventionally exposed to light through a step tablet and then processed using standard development chemistry and processes well known in the art for chloride emulsions. The sensitometric parameters reported below are the result of measuring the resultant densities in reflection mode. In the table below, photographic sensitivity (SPEED) is defined as the inverse logarithm of the exposure to light necessary to produce a density midway on the characteristic curve. A SPEED difference of 30 therefore corresponds to a twofold sensitivity difference (i.,e., "one stop"). SPEED is reported relative to the EG-1 comparison emulsion.

| Emulsion | Comment | Optical SPEED | Laser SPEED |
|---|---|---|---|
| EG-1 | Comparison | 100 | 100 |
| EG-2 | Invention | 70 | 61 |
| EG-3 | Invention | 47 | 40 |

Emulsion Example 4

Emulsions ER-1 and ER-2 were coated on a reflective support in a conventional single layer format, given either a stepped exposure using a red laser or conventionally exposed to light through a step tablet and then processed using standard development chemistry and processes well known in the art for chloride emulsions. The sensitometric parameters reported below are the result of measuring the resultant densities in reflection mode. In the table below, photographic sensitivity (SPEED) is defined as the inverse logarithm of the exposure to light necessary to produce a density midway on the characteristic curve. A SPEED difference of 30 therefore corresponds to a twofold sensitivity difference (i.,e., "one stop"). SPEED is reported relative to the ER-1 comparison emulsion.

| Emulsion | Comment | Optical SPEED | Laser SPEED |
|---|---|---|---|
| ER-1 | Comparison | 100 | 100 |
| ER-2 | Invention | 47 | 53 |

DUPLITIZED PHOTOGRAPHIC EXAMPLES

The following layer formulations are used in the examples below and were prepared by methods well known to the art. Structures for all of the numbered components are shown below. All material laydowns are expressed in terms of $g/m^2$.

| | |
|---|---|
| FBL-1: Face Blue Sensitive Layer | |
| Gelatin | 1.246 |
| Blue Sensitive Silver EB-1 | 0.280 |
| Y-1 | 0.452 |
| ST-1 | 0.078 |
| ST-2 | 0.026 |
| Diundecyl phthalate | 0.198 |
| FBL-2: Face Blue Sensitive Layer | |
| Gelatin | 1.246 |
| Blue Sensitive Silver EB-1 | 0.280 |
| Y-1 | 0.452 |
| ST-1 | 0.078 |
| ST-2 | 0.026 |
| Diundecyl phthalate | 0.198 |
| Potassium tolylthiosulfonate (TSS) | 0.010 |
| Potassium tolylsulfinate (TS) | 0.001 |
| FBL-3: Face Blue Sensitive Layer | |
| Gelatin | 1.246 |
| Blue Sensitive Silver EB-3 | 0.280 |
| Y-1 | 0.452 |
| ST-1 | 0.078 |
| ST-2 | 0.026 |
| Diundecyl phthalate | 0.198 |
| FBL-4: Face Blue Sensitive Layer | |
| Gelatin | 1.246 |
| Blue Sensitive Silver EB-1 | 0.280 |
| Y-1 | 0.452 |
| ST-1 | 0.078 |
| ST-2 | 0.026 |
| Diundecyl phthalate | 0.198 |
| Potassium tolylthiosulfonate (TSS) | 0.014 |
| Potassium tolylsulfinate (TS) | 0.0014 |
| FBL-5: Face Blue Sensitive Layer | |
| Gelatin | 1.246 |
| Blue Sensitive Silver EB-3 | 0.280 |
| Y-1 | 0.452 |
| ST-1 | 0.078 |
| ST-2 | 0.026 |
| Diundecyl phthalate | 0.198 |
| Potassium tolylthiosulfonate (TSS) | 0.014 |
| Potassium tolylsulfinate (TS) | 0.0014 |
| FBL-6: Face Blue Sensitive Layer | |
| Gelatin | 1.277 |
| Blue Sensitive Silver EB-1 | 0.350 |
| Y-1 | 0.452 |
| ST-1 | 0.078 |
| ST-2 | 0.026 |
| Diundecyl phthalate | 0.198 |
| FBL-7: Face Blue Sensitive Layer | |
| Gelatin | 1.246 |
| Blue Sensitive Silver EB-4 | 0.280 |

-continued

| | |
|---|---|
| Y-1 | 0.452 |
| ST-1 | 0.078 |
| ST-2 | 0.026 |
| Diundecyl phthalate | 0.198 |
| BBL-1: Back Blue Sensitive Layer | |
| Gelatin | 1.631 |
| Blue Sensitive Silver EB-1 | 0.420 |
| Y-1 | 0.807 |
| ST-1 | 0.139 |
| ST-2 | 0.046 |
| Diundecyl phthalate | 0.354 |
| BBL-2: Back Blue Sensitive Layer | |
| Gelatin | 1.522 |
| Blue Sensitive Silver EB-1 | 0.420 |
| Y-1 | 0.646 |
| ST-1 | 0.111 |
| ST-2 | 0.037 |
| Diundecyl phthalate | 0.283 |
| BBL-3: Back Blue Sensitive Layer | |
| Gelatin | 1.305 |
| Blue Sensitive Silver EB-1 | 0.336 |
| Y-1 | 0.646 |
| ST-1 | 0.111 |
| ST-2 | 0.037 |
| Diundecyl phthalate | 0.283 |
| BBL-4: Back Blue Sensitive Layer | |
| Gelatin | 1.305 |
| Blue Sensitive Silver EB-1 | 0.336 |
| Y-2 | 0.463 |
| ST-1 | 0.193 |
| ST-2 | 0.028 |
| ST-5 | 0.110 |
| Tributyl citrate | 0.243 |
| BBL-5: Back Blue Sensitive Layer | |
| Gelatin | 1.342 |
| Blue Sensitive Silver EB-1 | 0.350 |
| Y-1 | 0.646 |
| ST-1 | 0.111 |
| ST-2 | 0.037 |
| Diundecyl phthalate | 0.283 |
| BBL-6: Back Blue Sensitive Layer | |
| Gelatin | 1.161 |
| Blue Sensitive Silver EB-1 | 0.280 |
| Y-1 | 0.646 |
| ST-1 | 0.111 |
| ST-2 | 0.037 |
| Diundecyl phthalate | 0.283 |
| SY-1: Split Yellow Layer | |
| Gelatin | 0.323 |
| Y-1 | 0.194 |
| ST-1 | 0.033 |
| ST-2 | 0.011 |
| Diundecyl phthalate | 0.085 |
| FIL-1: Face Interlayer | |
| Gelatin | 0.753 |
| 2,5-Di-tert-octyl hydroquinone | 0.066 |
| Dibutyl phthalate | 0.188 |
| Disodium 4,5 Dihydroxy-m-benzenedisulfonate | 0.065 |
| Irganox 1076 ™ | 0.010 |
| BIL-1: Back Interlayer | |
| Gelatin | 0.753 |
| 2,5-Di-tert-octyl hydroquinone | 0.066 |
| Dibutyl phthalate | 0.188 |
| Disodium 4,5 Dihydroxy-m-benzenedisulfonate | 0.032 |
| Irganox 1076 ™ | 0.010 |
| FGL-1: Face Green Sensitive Layer | |
| Gelatin | 1.364 |
| Green Sensitive Silver EG-1 | 0.113 |
| M-1 | 0.214 |

-continued

| | |
|---|---|
| Dibutyl phthalate | 0.076 |
| ST-4 | 0.058 |
| ST-5 | 0.163 |
| ST-6 | 0.543 |
| FGL-2: Face Green Sensitive Layer | |
| Gelatin | 1.364 |
| Green Sensitive Silver EG-1 | 0.113 |
| M-1 | 0.214 |
| Dibutyl phthalate | 0.076 |
| ST-4 | 0.058 |
| ST-5 | 0.163 |
| ST-6 | 0.543 |
| Potassium tolylthiosulfonate (TSS) | 0.0004 |
| Potassium tolylsulfinate (TS) | 0.00004 |
| FGL-3: Face Green Sensitive Layer | |
| Gelatin | 1.364 |
| Green Sensitive Silver EG-2 | 0.113 |
| M-1 | 0.214 |
| Dibutyl phthalate | 0.076 |
| ST-4 | 0.058 |
| ST-5 | 0.163 |
| ST-6 | 0.543 |
| FGL-4: Face Green Sensitive Layer | |
| Gelatin | 1.364 |
| Green Sensitive Silver EG-3 | 0.113 |
| M-1 | 0.214 |
| Dibutyl phthalate | 0.076 |
| ST-4 | 0.058 |
| ST-5 | 0.163 |
| ST-6 | 0.543 |
| FGL-5: Face Green Sensitive Layer | |
| Gelatin | 1.364 |
| Green Sensitive Silver EG-1 | 0.113 |
| M-1 | 0.214 |
| Dibutyl phthalate | 0.076 |
| ST-4 | 0.058 |
| ST-5 | 0.163 |
| ST-6 | 0.543 |
| Potassium tolylthiosulfonate (TSS) | 0.0005 |
| Potassium tolylsulfinate (TS) | 0.00005 |
| FGL-6: Face Green Sensitive Layer | |
| Gelatin | 1.264 |
| Green Sensitive Silver EG-1 | 0.129 |
| M-1 | 0.214 |
| Dibutyl phthalate | 0.076 |
| ST-4 | 0.058 |
| ST-5 | 0.163 |
| ST-6 | 0.543 |
| BGL-1: Back Green Sensitive Layer | |
| Gelatin | 1.630 |
| Green Sensitive Silver EG-1 | 0.145 |
| M-1 | 0.268 |
| Dibutyl phthalate | 0.095 |
| ST-4 | 0.073 |
| ST-5 | 0.204 |
| ST-6 | 0.679 |
| BGL-2: Back Green Sensitive Layer | |
| Gelatin | 1.440 |
| Green Sensitive Silver EG-1 | 0.145 |
| M-1 | 0.214 |
| Dibutyl phthalate | 0.076 |
| ST-4 | 0.058 |
| ST-5 | 0.163 |
| ST-6 | 0.543 |
| BGL-3: Back Green Sensitive Layer | |
| Gelatin | 1.303 |
| Green Sensitive Silver EG-1 | 0.116 |
| M-1 | 0.214 |
| Dibutyl phthalate | 0.076 |
| ST-4 | 0.058 |

-continued

| | |
|---|---|
| ST-5 | 0.163 |
| ST-6 | 0.543 |
| BGL-4: Back Green Sensitive Layer | |
| Gelatin | 1.264 |
| Green Sensitive Silver EG-1 | 0.129 |
| M-1 | 0.214 |
| Dibutyl phthalate | 0.076 |
| ST-4 | 0.058 |
| ST-5 | 0.163 |
| ST-6 | 0.543 |
| BGL-5: Back Green Sensitive Layer | |
| Gelatin | 1.365 |
| Green Sensitive Silver EG-1 | 0.129 |
| M-1 | 0.214 |
| Dibutyl phthalate | 0.076 |
| ST-4 | 0.058 |
| ST-5 | 0.163 |
| ST-6 | 0.543 |
| UV IL-1: UV Interlayer | |
| Gelatin | 0.712 |
| UV-1 | 0.030 |
| UV-2 | 0.172 |
| 2,5-Di-tert-octyl hydroquinone | 0.055 |
| Dibutyl phthalate | 0.034 |
| 1,4-Cyclohexylenedimethylene bis(2-ethylhexanoate) | 0.034 |
| FRL-1 Face Red Sensitive Layer | |
| Gelatin | 1.211 |
| Red Sensitive Silver ER-1 | 0.200 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.001 |
| Potassium tolylsulfinate (TS) | 0.0001 |
| FRL-2 Face Red Sensitive Layer | |
| Gelatin | 1.211 |
| Red Sensitive Silver ER-1 | 0.200 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.0025 |
| Potassium tolylsulfinate (TS) | 0.00025 |
| FRL-3 Face Red Sensitive Layer | |
| Gelatin | 1.211 |
| Red Sensitive Silver ER-2 | 0.200 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.001 |
| Potassium tolylsulfinate (TS) | 0.0001 |
| FRL-4 Face Red Sensitive Layer | |
| Gelatin | 1.211 |
| Red Sensitive Silver ER-1 | 0.200 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.0023 |
| Potassium tolylsulfinate (TS) | 0.00023 |
| FRL-5 Face Red Sensitive Layer | |
| Gelatin | 1.335 |
| Red Sensitive Silver ER-1 | 0.264 |
| C-1 | 0.400 |
| Dibutyl phthalate | 0.392 |
| UV-2 | 0.259 |

-continued

| | |
|---|---|
| 2-(2-butoxyethoxy)ethyl acetate | 0.033 |
| 2,5-Di-tert-octyl hydroquinone | 0.003 |
| Potassium tolylthiosulfonate (TSS) | 0.001 |
| Potassium tolylsulfinate (TS) | 0.0001 |
| BRL-1 Back Red Sensitive Layer | |
| Gelatin | 1.699 |
| Red Sensitive Silver ER-1 | 0.316 |
| C-1 | 0.500 |
| Dibutyl phthalate | 0.490 |
| UV-2 | 0.324 |
| 2-(2-butoxyethoxy)ethyl acetate | 0.041 |
| 2,5-Di-tert-octyl hydroquinone | 0.004 |
| Potassium tolylthiosulfonate (TSS) | 0.004 |
| Potassium tolylsulfinate (TS) | 0.0004 |
| BRL-2 Back Red Sensitive Layer | |
| Gelatin | 1.538 |
| Red Sensitive Silver ER-1 | 0.316 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.003 |
| Potassium tolylsulfinate (TS) | 0.0003 |
| BRL-3 Back Red Sensitive Layer | |
| Gelatin | 1.360 |
| Red Sensitive Silver ER-1 | 0.253 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.003 |
| Potassium tolylsulfinate (TS) | 0.0003 |
| BRL-4 Back Red Sensitive Layer | |
| Gelatin | 1.335 |
| Red Sensitive Silver ER-1 | 0.264 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.003 |
| Potassium tolylsulfinate (TS) | 0.0003 |
| BRL-5 Back Red Sensitive Layer | |
| Gelatin | 1.450 |
| Red Sensitive Silver ER-1 | 0.285 |
| C-1 | 0.400 |
| Dibutyl phthalate | 0.392 |
| UV-2 | 0.259 |
| 2-(2-butoxyethoxy)ethyl acetate | 0.033 |
| 2,5-Di-tert-octyl hydroquinone | 0.003 |
| Potassium tolylthiosulfonate (TSS) | 0.004 |
| Potassium tolylsulfinate (TS) | 0.0004 |
| UV-1: UV Overcoat | |
| Gelatin | 0.537 |
| UV-1 | 0.023 |
| UV-2 | 0.130 |
| 2,5-Di-tert-octyl hydroquinone | 0.042 |
| Dibutyl phthalate | 0.025 |
| 1,4-Cyclohexylenedimethylene bis(2-ethylhexanoate) | 0.025 |
| TEL-1: Tone Enhancing Layer | |
| Gelatin | 1.130 |
| 2,5-Di-tert-octyl hydroquinone | 0.066 |
| Titanium Dioxide | 1.615 |
| Dibutyl phthalate | 0.188 |
| Irganox 1076 ™ | 0.010 |
| TEL-2: Tone Enhancing Layer | |
| Gelatin | 0.753 |
| 2,5-Di-tert-octyl hydroquinone | 0.066 |
| Titanium Dioxide | 1.076 |

-continued

| | |
|---|---|
| Dibutyl phthalate | 0.188 |
| Irganox 1076 ™ | 0.010 |
| TEL-3: Tone Enhancing Layer | |
| Gelatin | 1.130 |
| 2,5-Di-tert-octyl hydroquinone | 0.099 |
| Titanium Dioxide | 1.615 |
| Dibutyl phthalate | 0.282 |
| Irganox 1076 ™ | 0.015 |
| FOC-1: Face Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-1 | 0.011 |
| Dye-2 | 0.004 |
| Dye-3 | 0.009 |
| FOC-2: Face Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-1 | 0.032 |
| Dye-2 | 0.013 |
| Dye-3 | 0.026 |
| FOC-3: Face Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-1 | 0.065 |
| Dye-2 | 0.034 |
| Dye-3 | 0.026 |
| FOC-4: Face Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-1 | 0.065 |
| Dye-2 | 0.026 |
| Dye-3 | 0.026 |
| BOC-1: Back Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-4 | 0.054 |
| Dye-5 | 0.108 |
| BOC-2: Back Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-4 | 0.013 |
| Dye-5 | 0.027 |
| BOC-3: Back Overcoat | |
| Gelatin | 1.076 |
| 2,5-Di-tert-octyl hydroquinone | 0.013 |
| Dibutyl phthalate | 0.039 |
| SF-1 | 0.009 |

-continued

| | |
|---|---|
| SF-2 | 0.004 |
| Polystyrene Matte Beads (2.5 μm average diameter) | 0.013 |
| Dye-4 | 0.005 |
| Dye-5 | 0.011 |
| BOC-4: Back Overcoat | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| BOC-5: Back Overcoat | |
| Gelatin | 0.861 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-4 | 0.013 |
| Dye-5 | 0.027 |

Y-1

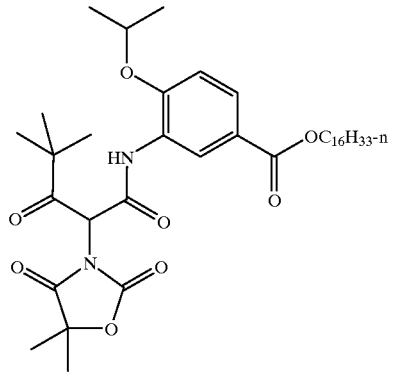

Y-2

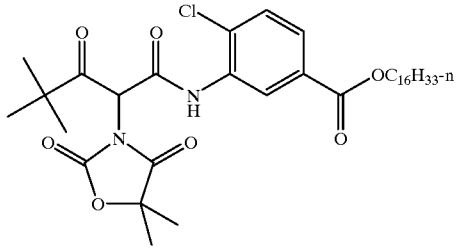

M-1

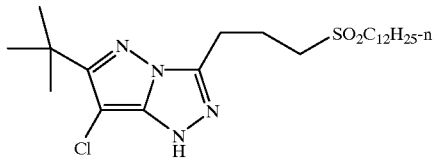

-continued
C-1
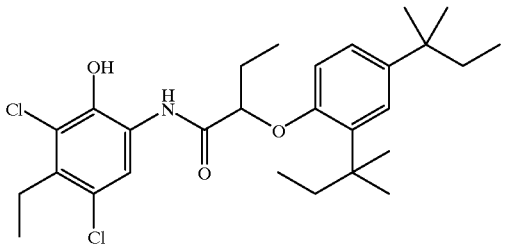
ST-1
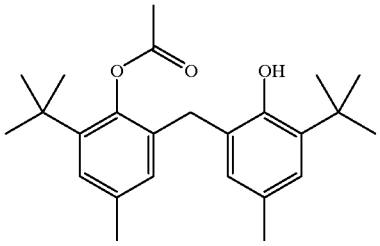
ST-2
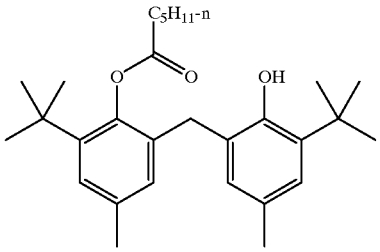
ST-3
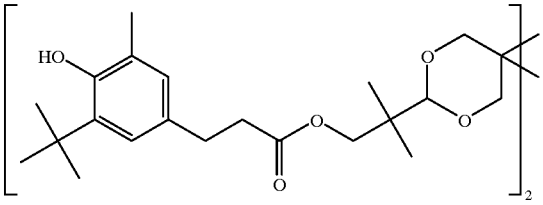
ST-4
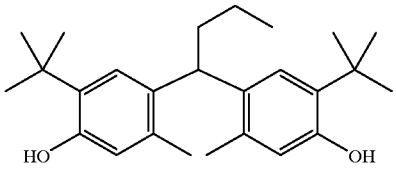
ST-5
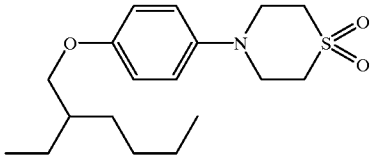
ST-6
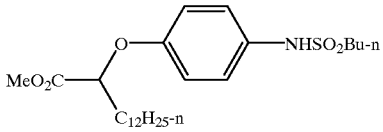
-continued
DYE-1
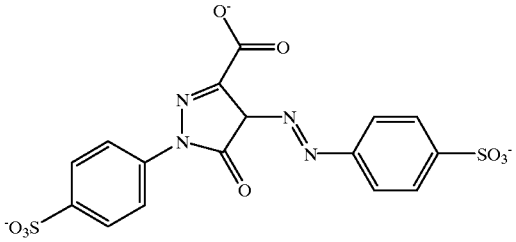
DYE-2
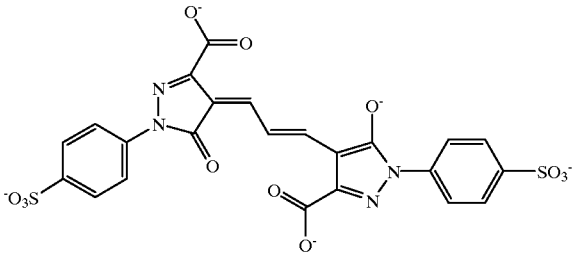
DYE-3
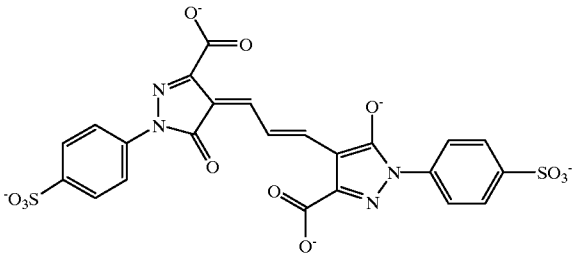
DYE-4
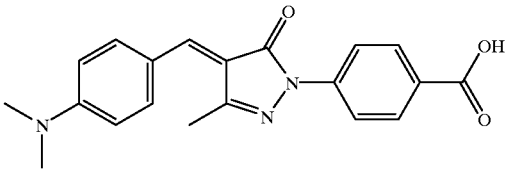
DYE-5
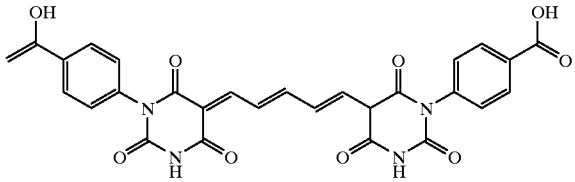
UV-1
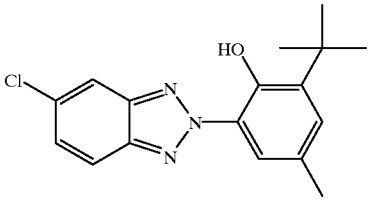

-continued

UV-2

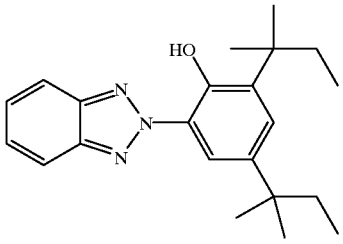

SF-1

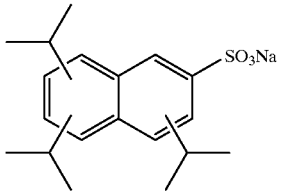

SF-2

$CF_3 \cdot (CF_2)_7 \cdot SO_3Na$

SF-2

$CF_3.(CF_2)_7.SO_3Na$

Photographic Example 1

Coatings 1-1 to 1-4 were prepared as described in Table 1. In the case of Example 1-2, in a manner as disclosed in U.S. Pat. No. 5,840,473 and U.S. Pat. No. 5,849,470, a 10:1 mixture of potassium tolylthiosulfonate (TSS)/potassium tolylsulfinate (TS) was added to the silver bearing emulsion melt and held for 1–2 hours at 40° C. prior to coating with the coupler dispersion.

TABLE 1

| Variation<br>Comment | 1-1<br>Comparison | 1-2<br>Invention | 1-3<br>Invention | 1-4<br>Invention |
|---|---|---|---|---|
| Face SOC | FOC-1 | FOC-1 | FOC-2 | FOC-1 |
| UV Layer | FUV-1 | FUV-1 | FUV-1 | FUV-1 |
| Face Red Layer | FRL-1 | FRL-2 | FRL-2 | FRL-3 |
| UV Interlayer | UV IL-1 | UV IL-1 | UV IL-1 | UV IL-1 |
| Face Green Layer | FGL-1 | FGL-2 | FGL-1 | FGL-3 |
| Face Interlayer | FIL-1 | FIL-1 | FIL-1 | FIL-1 |
| Split Yellow Layer | SY-1 | SY-1 | SY-1 | SY-1 |
| Face Blue Layer | FBL-1 | FBL-2 | FBL-2 | FBL-3 |
| Support | S-1 | S-1 | S-1 | S-1 |
| Back Blue Layer | BBL-1 | BBL-1 | BBL-1 | BBL-1 |
| Back Yellow Layer | None | None | None | None |
| Back Interlayer | BIL-1 | BIL-1 | BIL-1 | BIL-1 |
| Back Green Layer | BGL-1 | BGL-1 | BGL-1 | BGL-1 |
| Back Interlayer | BIL-1 | BIL-1 | BIL-I | BIL-1 |
| Back Red Layer | BRL-1 | BRL-1 | BRL-1 | BRL-1 |
| Tone Enhancing Layer | TEL-1 | TEL-1 | TEL-1 | TEL-1 |
| Back SOC | BOC-1 | BOC-1 | BOC-1 | BOC-1 |

The structure of support S-1 was as follows:

Clear gelatin sub coating
5 layer biaxially oriented polyolefin sheet containing Optical Brightener, $TiO_2$, red and blue tints
Metallocene ethylene plastomer
Clear gelatin sub coating
Transparent polyester base
Clear gelatin sub coating containing a tine oxide antistat The samples were given a 21-step neutral exposure (exposure increments of 0.15 log E) by use of a laser sensitometer and then were processed in a standard RA-4 process (developer time 45 sec). The parameters reported below are the result of measuring the resultant densities in transmission mode. In the table below, SPD080 is defined as the relative speed at a density 0.8 above Dmin, wherein Dmin is the minimum density obtained after processing of an unexposed region of the photographic element. SHLD6 is a shoulder density 0.6 log E slow of the speed at SPD080. BFC stands for Best Fit Contrast, wherein BFC is equal to the (Density 1–Density 2)/0.4. Density 1 is defined as a density of Dmin +1.3, and Density 2 is the density at +0.4 log H of Density 1.

TABLE 2

| Variation | Comment | SPD080 (RGB) | SHLD6 (RGB) | BFC (RGB) |
|---|---|---|---|---|
| | | Neutral Exposure, Read in Transmission | | |
| 1-1 | Comparison | 1.30, 1.35, 1.33 | 2.69, 2.49, 2.22 | 3.2, 2.9, 2.4 |
| 1-2 | Invention | 1.18, 1.14, 1.22 | 2.89, 2.80, 2.52 | 3.6, 3.5, 2.9 |
| 1-3 | Invention | 0.96, 0.95, 1.03 | 2.97, 2.86, 2.54 | 3.9, 3.7, 3.1 |
| 1-4 | Invention | 1.18, 1.12, 1.25 | 3.03, 2.80, 2.93 | 4.0, 3.5, 3.2 |

As is seen by comparison of the SPD080 values, the inventive examples show slower speeds by up to 0.34 log E relative to the check. The SPD080 effectively is a measure of the face side speed of the photographic elements. As the speed gap between the face and backsides of the element is reduced, the contrast of the overall element in transmission mode is increased. Thus, the inventive examples have uniformly higher contrast and higher upper scale density with respect to comparison coating 1-1. This increase contrast can be used to enable reduction of silver lay downs which, in turn, leads to reduced costs and reduced process sensitivity, particularly in a seasoned process. Alternatively, the higher contrast can be used to achieve a more pleasing balance between reflection and transmission viewing properties.

In particular, comparison of 1-1 to 1-2 shows that if the speeds of the face side emulsions are reduced relative to the back, that both higher upper scale densities and higher contrast result. If the speeds are further reduced by tripling the amount of absorber dye used for the face side as in 1-3, even higher shoulders and contrast are obtained. Finally, use of intrinsically slower emulsions on the face side also shows the same improvements relative to the comparison 1-1.

Photographic Example 2

Coatings 2-1 to 2-7 were prepared as described in Tables 3 and 4.

TABLE 3

| Variation<br>Comment | 2-1<br>Comparison | 2-2<br>Invention | 2-3<br>Invention | 2-4<br>Invention |
|---|---|---|---|---|
| Face SOC | FOC-1 | FOC-1 | FOC-2 | FOC-2 |
| UV Layer | FUV-1 | FUV-1 | FUV-1 | FUV-1 |
| Face Red Layer | FRL-1 | FRL-1 | FRL-1 | FRL-1 |
| UV Interlayer | UV IL-1 | UV IL-1 | UV IL-1 | UV IL-1 |
| Face Green Layer | FGL-1 | FGL-1 | FGL-1 | FGL-1 |
| Face Interlayer | FIL-1 | FIL-1 | FIL-1 | FIL-1 |
| Split Yellow Layer | SY-1 | SY-1 | SY-1 | SY-1 |
| Face Blue Layer | FBL-1 | FBL-1 | FBL-1 | FBL-1 |
| Support | S-1 | S-1 | S-1 | S-1 |
| Back Blue Layer | BBL-2 | BBL-2 | BBL-2 | BBL-2 |
| Back Yellow Layer | None | None | None | None |
| Back Interlayer | BIL-1 | BIL-1 | BIL-1 | BIL-1 |

TABLE 3-continued

| Variation<br>Comment | 2-1<br>Comparison | 2-2<br>Invention | 2-3<br>Invention | 2-4<br>Invention |
|---|---|---|---|---|
| Back Green Layer | BGL-2 | BGL-2 | BGL-2 | BGL-2 |
| Back Interlayer | BIL-1 | BIL-1 | BIL-1 | BIL-1 |
| Back Red Layer | BRL-2 | BRL-2 | BRL-2 | BRL-1 |
| Tone Enhancing Layer | TEL-1 | TEL-1 | TEL-1 | TEL-1 |
| Back SOC | BOC-1 | BOC-2 | BOC-2 | BOC-3 |

TABLE 4

| Variation<br>Comment | 2-5<br>Comparison | 2-6<br>Invention | 2-7<br>Invention |
|---|---|---|---|
| Face SOC | FOC-2 | FOC-2 | FOC-2 |
| UV Layer | FUV-1 | FUV-1 | FUV-1 |
| Face Red Layer | FRL-1 | FRL-1 | FRL-1 |
| UV Interlayer | UV IL-1 | UV IL-1 | UV IL-1 |
| Face Green Layer | FGL-4 | FGL-5 | FGL-5 |
| Face Interlayer | FIL-1 | FIL-1 | FIL-1 |
| Split Yellow Layer | SY-1 | SY-1 | SY-1 |
| Face Blue Layer | FBL-1 | FBL-1 | FBL-1 |
| Support | S-1 | S-1 | S-1 |
| Back Blue Layer | BBL-2 | BBL-3 | BBL-4 |
| Back Yellow Layer | None | None | None |
| Back Interlayer | BIL-1 | BIL-1 | BIL-1 |
| Back Green Layer | BGL-2 | BGL-3 | BGL-3 |
| Back Interlayer | BIL-1 | BIL-1 | BIL-1 |
| Back Red Layer | BRL-2 | BRL-3 | BRL-3 |
| Tone Enhancing Layer | TEL-1 | TEL-1 | TEL-1 |
| Back SOC | BOC-3 | BOC-3 | BOC-3 |

The samples were given a neutral step exposure using a laser sensitometer, processed and the resultant densities were measured in transmission mode as described in Example 1. Data are reported only for the green and blue color records, although similar effects would be expected for the red color record.

TABLE 5

| | | Neutral Exposure, Read in Transmission | | |
|---|---|---|---|---|
| Variation | Comment | SPD080 (GB) | SHLD6 (GB) | BFC (GB) |
| 2-1 | Comparison | 1.64, 1.64 | 2.46, 2.25 | 2.84, 2.40 |
| 2-2 | Invention | 1.66, 1.69 | 2.44, 2.46 | 2.85, 2.77 |
| 2-3 | Invention | 1.44, 1.50 | 2.62, 2.61 | 3.06, 3.07 |
| 2-4 | Invention | 1.45, 1.50 | 2.70, 2.76 | 3.27, 3.35 |
| 2-5 | Invention | 1.35, 1.50 | 2.76, 2.71 | 3.45, 3.29 |
| 2-6 | Invention | 1.35, 1.49 | 2.66, 2.71 | 3.18, 3.24 |
| 2-7 | Invention | 1.33, 1.48 | 2.74, 2.84 | 3.34, 3.61 |

The impact of lower the level of antihalation protection is shown by Examples 2-1 to 2-2 and 2-3 to 2-4. There was a small benefit observed in the upper scale and contrast, particularly in the blue record when the level of antihalation was cut by 75%. Although reduction by 90% led to even greater contrast, this was found to be undesirable because at this lower level, antihalation protection was found to be insufficient to control backscatter in some of the commercially available digital printing devices. The element described in 2-2 was found to be virtually free from this defect.

Comparison of 2-2 to 2-3 once again shows the benefit of slowing down the face side emulsions with additional absorber dye. Note that the 3× increase of absorber dye level resulted in a 0.22 log E green speed loss and 0.19 log E blue speed loss, and that this translated into both increased transmission shoulder and increased transmission contrast.

Comparison of 2-4 to 2-5 shows the impact of using an intrinsically slower green emulsion for the face side than is used on the backside. The SPD080 parameter shows that use of this emulsion gave an element that was 0.10 log E slow in green speed relative to the comparison element, 2-4. Thus, reduction of the face to back speed gap by 0.1 log E resulted in a gain in both green shoulder and contrast.

The SPD080 data reported in Table 6 is the result of reading the same elements with a reflection densitometer. The Speed Gap was determined by reading the elements in transmission mode after selective removal of either the face or backsides of the element by carefully scrubbing the element with a commercial laundry bleach solution to remove the photographic emulsions. The Speed Gap, reported in log E, is obtained by subtracting the face side transmission SPD080 of the element from the backside transmission SPD080.

TABLE 6

| | | Separation Exposure | |
|---|---|---|---|
| Variation | Comment | SPD080 (GB)<br>Reflection | Speed Gap (GB)<br>Transmission |
| 2-2 | Invention | 1.72, 1.74 | −0.29, −0.30 |
| 2-3 | Invention | 1.49, 1.55 | −0.20, −0.24 |
| 2-4 | Invention | 1.49, 1.55 | −0.13, −0.21 |
| 2-5 | Invention | 1.28, 1.56 | +0.04, −0.20 |

Comparison of 2-2 to 2-3 shows that the 3× increase of face side absorber dye leads to a face side green speed loss of 0.23 log E and blue speed loss of 0.19 log E. Unexpectedly, in spite of the addition of more absorber dye, the speed gap between the face and backsides is narrowed by 0.09 log E green and 0.06 log E blue. This narrowing of the speed gap thus leads to an increase of both blue and green contrast (as seen in Table 5).

Comparison of 2-4 to 2-5 shows that the use of an inherently slower face side green emulsion (0.21 log E slower) substantially narrowed the speed gap between the face and backsides and that this, in turn, led to increased green contrast (see Table 5).

Photographic Example 3

Coatings 3-1 to 3-5 were prepared as described in Table 7. In the case of Examples 3-4 and 3-5, in a manner as disclosed in U.S. Pat. No. 5,840,473 and U.S. Pat. No. 5,849,470, a 10:1 mixture of potassium tolylthiosulfonate (TSS)/potassium tolylsulfinate (TS) was added to the silver bearing emulsion melt and held for 1-2 hours at 40° C. prior to coating with the coupler dispersion.

TABLE 7

| Variation<br>Comment | 3-1<br>Comparison | 3-2<br>Invention | 3-3<br>Invention | 3-4<br>Invention | 3-5<br>Invention |
|---|---|---|---|---|---|
| Face SOC | FOC-1 | FOC-2 | FOC-2 | FOC-2 | FOC-2 |
| UV Layer | FUV-1 | FUV-1 | FUV-1 | FUV-1 | FUV-I |
| Face Red Layer | FRL-1 | FRL-1 | FRL-1 | FRL-4 | FRL-3 |
| UV Interlayer | UV IL-1 | UV IL-1 | UV IL-1 | UV IL-1 | UV IL-1 |
| Face Green Layer | FGL-1 | FGL-1 | FGL-1 | FGL-5 | FGL-3 |
| Face Interlayer | FIL-1 | FIL-1 | FIL-1 | FIL-1 | FIL-1 |
| Split Yellow Layer | SY-1 | SY-1 | SY-1 | SY-1 | SY-1 |
| Face Blue Layer | FBL-1 | FBL-1 | FBL-1 | FBL-4 | FBL-5 |
| Support | S-1 | S-1 | S-1 | S-1 | S-1 |
| Back Blue Layer | BBL-2 | BBL-2 | BBL-2 | BBL-2 | BBL-2 |

TABLE 7-continued

| Variation Comment | 3-1 Comparison | 3-2 Invention | 3-3 Invention | 3-4 Invention | 3-5 Invention |
|---|---|---|---|---|---|
| Back Yellow Layer | None | None | None | None | None |
| Back Interlayer | BIL-1 | BIL-1 | BIL-1 | BIL-1 | BIL-1 |
| Back Green Layer | BGL-2 | BGL-2 | BGL-2 | BGL-2 | BGL-2 |
| Back Interlayer | BIL-1 | BIL-1 | BIL-1 | BIL-1 | BIL-1 |
| Back Red Layer | BRL-2 | BRL-2 | BRL-2 | BRL-2 | BRL-2 |
| Tone Enhancing Layer | TEL-1 | TEL-1 | TEL-1 | TEL-1 | TEL-1 |
| Back SOC | BOC-1 | BOC-2 | BOC-4 | BOC-1 | BOC-1 |

The samples were given either a nominally neutral step exposure or a separation step exposure using a laser sensitometer, processed and the resultant densities were measured in transmission mode and reflection modes as described in previous examples.

TABLE 8

Neutral Exposure, Read in Transmission

| Variation | Comment | SPD080 (RGB) | SHLD6 (RGB) | BFC (RGB) |
|---|---|---|---|---|
| 3-1 | Comparison | 1.56, 1.60, 1.64 | 2.58, 2.31, 2.30 | 3.1, 2.6, 2.6 |
| 3-2 | Invention | 1.35, 1.41, 1.50 | 2.92, 2.65, 2.52 | 3.7, 3.2, 2.9 |
| 3-3 | Invention | 1.47, 1.51, 1.54 | 3.12, 2.96, 2.67 | 4.2, 3.9, 3.2 |
| 3-4 | Invention | 1.24, 1.28, 1.29 | 2.75, 2.64, 2.83 | 3.3, 3.2, 3.7 |
| 3-5 | Invention | 1.05, 1.05, 1.17 | 2.80, 2.76, 2.66 | 3.5, 3.5, 3.3 |

TABLE 9

Separation Exposure

| Variation | Comment | SPD080 (RGB) Reflection | Speed Gap (RGB) Transmission |
|---|---|---|---|
| 3-1 | Comparison | 1.65, 1.65, 1.67 | −0.38, −0.59, −0.57 |
| 3-2 | Invention | 1.41, 1.47, 1.56 | −0.24, −0.42, −0.54 |
| 3-3 | Invention | 1.43, 1.48, 1.56 | +0.10, −0.13, −0.37 |
| 3-4 | Invention | 1.30, 1.31, 1.30 | −0.32, −0.43, −0.47 |
| 3-5 | Invention | 0.97, 0.94, 1.16 | 0.14, −0.04, −0.23 |

Comparison of 3-1 to 3-2 shows the benefit of tripling the amount of face side absorber dye and decreasing by 75% the level of backside antihalation protection as both upper scale and contrast are increased (see Table 8). Examination of the data in Table 9 shows that as the face side speed is reduced, the speed gap is also reduced.

Decreasing the level of backside antihalation protection to zero, as in 3-3, leads to even higher upper scale densities and contrast. In this case, the effective speed of the backside emulsions have been increased with lower antihalation protection, and the speed gap is thus reduced. However, it has been found that image artifacts result from uncontrolled backscatter in certain commercially available digital printers without antihalation protection.

In Examples 3-4 and 3-5, methods were employed to slow down the face side silver halide emulsion layers such as the use of TSS and/or the use of intrinsically slower emulsions. In both cases, upper scale density and contrast were improved relative to the comparison. As can be seen in Table 9, these methods effectively close the face to back speed gap. In fact, prints from Example 3-5 are dramatically improved with respect to the quality of reflection and transmission viewing. When 3-5 was optimally printed for transmission quality, the reflection quality is still quite good without looking dark and blocked in.

Photographic Example 4

Coatings 4-1 and 4-4 were prepared as described in Table 10.

TABLE 10

| Variation Comment | 4-1 Comparison | 4-2 Invention | 4-3 Invention | 4-4 Invention |
|---|---|---|---|---|
| Face SOC | FOC-1 | FOC-1 | FOC-2 | FOC-3 |
| UV Layer | FUV-1 | FUV-1 | FUV-1 | FUV-1 |
| Face Red Layer | FRL-5 | FRL-1 | FRL-1 | FRL-1 |
| UV Interlayer | UV IL-1 | UV IL-1 | UV IL-1 | UV IL-1 |
| Face Green Layer | FGL-6 | FGL-1 | FGL-1 | FGL-1 |
| Face Interlayer | FIL-1 | FIL-1 | FIL-1 | FIL-1 |
| Split Yellow Layer | SY-1 | SY-1 | SY-1 | SY-1 |
| Face Blue Layer | FBL-6 | FBL-1 | FBL-1 | FBL-1 |
| Support | S-1 | S-1 | S-1 | S-1 |
| Back Blue Layer | BBL-5 | BBL-2 | BBL-2 | BBL-2 |
| Back Yellow Layer | None | None | None | None |
| Back Interlayer | BIL-1 | BIL-1 | BIL-1 | BIL-1 |
| Back Green Layer | BGL-4 | BGL-2 | BGL-2 | BGL-2 |
| Back Interlayer | BIL-1 | BIL-1 | BIL-1 | BIL-1 |
| Back Red Layer | BRL-4 | BRL-2 | BRL-2 | BRL-2 |
| Tone Enhancing Layer | TEL-2 | TEL-3 | TEL-1 | TEL-1 |
| Back SOC | BOC-1 | BOC-1 | BOC-5 | BOC-5 |

The samples were given either a nominally neutral step exposure or a separation step exposure using a laser sensitometer, processed and the resultant densities were measured in transmission mode and reflection modes as described in previous examples.

TABLE 11

Neutral Exposure, Transmission

| Variation | Comment | SPD080 (RGB) | SHLD6 (RGB) | BFC (RGB) |
|---|---|---|---|---|
| 4-1 | Comparison | 1.62, 1.65, 1.66 | 2.32, 2.22, 2.16 | 2.5, 2.3, 2.2 |
| 4-2 | Invention | 1.57, 1.62, 1.64 | 2.65, 2.38, 2.37 | 3.2, 2.7, 2.8 |
| 4-3 | Invention | 1.35, 1.43, 1.53 | 3.05, 2.76, 2.67 | 4.0, 3.4, 3.3 |
| 4-4 | Invention | 1.33, 1.25, 1.35 | 3.07, 2.81, 2.66 | 4.1, 3.5, 3.3 |

TABLE 12

Separation Exposure

| Variation | Comment | SPD080 (RGB) Reflection | Speed Gap (RGB) Transmission |
|---|---|---|---|
| 4-1 | Comparison | 1.75, 1.73, 1.72 | −0.63, −0.79, −0.75 |
| 4-2 | Invention | 1.79, 1.79, 1.79 | −0.39, −0.60, −0.60 |
| 4-3 | Invention | 1.38, 1.46, 1.57 | −0.20, −0.36, −0.48 |
| 4-4 | Invention | 1.36, 1.18, 1.35 | −0.12, −0.20, −0.33 |

Comparison of 4-2 to 4-1 shows that improved upper scale and contrast can be obtained by the use of more silver on the back relative to the face and by increasing the lay down of $TiO_2$ in the reflective layer. In this case, the speed gap is closed by effectively increasing the speed of the backside emulsion layers without any substantial impact on the face side performance. Further improvements in both shoulder and contrast were obtained with the addition of absorber dye (see 4-3 and 4-4 versus 4-2). In these cases, the addition of absorber dye slows down the face side emulsions more than the backside emulsions, thus leading to the improved performance. Evaluation of prints from 4-3 and 4-4 optimized for transmission viewing showed a marked improvement of the reflection image relative to 4-2 and dramatic improvement relative to 4-1.

Photographic Example 5

Coatings 5-1 and 5-3 were prepared as described in Table 13.

TABLE 13

| Variation<br>Comment | 5-1<br>Invention | 5-2<br>Invention | 5-3<br>Invention |
|---|---|---|---|
| Face SOC | FOC-4 | FOC-4 | FOC-4 |
| UV Layer | FUV-1 | FUV-1 | FUV-1 |
| Face Red Layer | FRL-5 | FRL-5 | FRL-3 |
| UV Interlayer | UV IL-1 | UV IL-1 | UV IL-1 |
| Face Green Layer | FGL-6 | FGL-6 | FGL-3 |
| Face Interlayer | FIL-1 | FIL-1 | FIL-1 |
| Split Yellow Layer | SY-1 | SY-1 | SY-1 |
| Face Blue Layer | FBL-6 | FBL-6 | FBL-7 |
| Support | S-1 | S-1 | S-1 |
| Back Blue Layer | BBL-5 | BBL-6 | BBL-6 |
| Back Yellow Layer | None | None | None |
| Back Interlayer | BIL-1 | BIL-1 | BIL-1 |
| Back Green Layer | BGL-4 | BGL-5 | BGL-5 |
| Back Interlayer | BIL-1 | BIL-1 | BIL-1 |
| Back Red Layer | BRL-4 | BRL-5 | BRL-5 |
| Tone Enhancing Layer | TEL-1 | TEL-1 | TEL-1 |
| Back SOC | BOC-5 | BOC-5 | BOC-5 |

The samples were given either a nominally neutral step exposure or a separation step exposure using a laser sensitometer, processed and the resultant densities were measured in transmission mode and reflection modes as described in previous examples.

TABLE 14

Neutral Exposure, Transmission

| Variation | Comment | SPD080 (RGB) | SHLD6 (RGB) | BFC (RGB) |
|---|---|---|---|---|
| 5-1 | Invention | 1.31, 1.28, 1.29 | 2.90, 2.68, 2.51 | 3.7, 3.3, 3.0 |
| 5-2 | Invention | 1.30, 1.28, 1.29 | 2.72, 2.54, 2.34 | 3.4, 3.0, 2.6 |
| 5-3 | Invention | 1.06, 0.96, 0.93 | 2.72, 2.66, 2.23 | 3.3, 3.1, 2.2 |

TABLE 15

Separation Exposure

| Variation | Comment | SPD080 (RGB) Reflection | Speed Gap (RGB) Transmission |
|---|---|---|---|
| 5-1 | Invention | 1.37, 1.30, 1.33 | −0.25, −0.37, −0.42 |
| 5-2 | Invention | 1.37, 1.30, 1.34 | −0.29, −0.44, −0.55 |
| 5-3 | Invention | 0.94, 0.76, 0.82 | 0.24, 0.11, −0.01 |

Comparison of 5-1 to 5-2 shows the impact of lowering the level of backside silver. Although the face side speed is unchanged, the upper scale contrast is somewhat reduced. Comparison of 5-2 to 5-3 shows that it is possible to decrease the sensitivity of the face side emulsions too much. In this case, both the red and especially the blue contrast values are reduced.

What is claimed is:

1. A photographic element comprising a base material, at least one exposure side photosensitive silver halide layer, and at least one backside photosensitive silver halide layer, wherein said face side photosensitive layer has lower speed than said backside photosensitive layer, and wherein said base material has a percent transmission of between 35 and 60% and wherein the effective speed difference between the exposure side and the backside silver halide layer is between 0.15 and 0.6 log E.

2. The photographic element of claim 1 wherein said element after exposure and processing for development has an MTF difference of no more than 3 DMT between the exposure side image and the backside image.

3. The photographic element of claim 1 wherein said element is provided with at least one layer comprising voids.

4. The photographic element of claim 1 wherein said at least one photosensitive silver halide containing layer on the exposure side comprises absorber dyes.

5. The photographic element of claim 4 wherein said backside silver halide containing layer and said front side silver halide containing layer comprise substantially the same silver halide grains.

6. The photographic element of claim 1 wherein said exposure side silver halide grains are substantially slower than the backside silver halide grains.

7. The photographic element of claim 1 wherein said element after exposure and processing for development has the exposure side and backside image of substantially the same density.

8. The photographic element of claim 1 wherein said backside layer is coated on the side away from exposure with an antihalation layer.

9. The photographic element of claim 1 wherein said base comprises at least one layer comprising $TiO_2$ in an amount of between 2 and 6%.

10. The photographic element of claim 1 wherein said base is substantially free of $TiO_2$.

11. The photographic element of claim 1 wherein said base material has a transmission of between 38 and 55%.

12. The photographic element of claim 1 wherein said base has a stiffness of at least 150 millinewtons.

13. The photographic element of claim 1 wherein said base comprises polyester.

14. The photographic element of claim 1 wherein said base comprises polyolefin.

15. The photographic element of claim 1 wherein said base comprises a biaxially oriented voided polyolefin sheet adhesively adhered to a transparent polyester sheet.

16. The photographic element of claim 1 wherein said speed difference is about 0.3 log E.

17. The photographic element of claim 1 wherein said speed difference is about 0.15 log E.

18. The photographic element of claim 1 wherein said base comprises a voided polyester sheet adhesively adhered to a transparent polyester sheet.

19. A method of forming a display element comprising providing a photographic element comprising a base material, at least one exposure side photosensitive silver halide layer, and at least one backside photosensitive silver halide layer, wherein said face side photosensitive layer has lower speed than said backside photosensitive layer, wherein the effective speed difference between the exposure side and the backside silver halide layers is between 0.15 and 0.6 log E, and wherein said base material has a percent transmission of between 35 and 60%, exposing said photographic element, developing the exposed image, wherein said exposed image has an MTF difference of no more than 3 DMT between the exposure side image and the backside image.

20. The method of claim 19 wherein said element after exposure and processing for development has an MTF difference of no more than 3 DMT between the exposure side image and the backside image.

21. The method of claim 19 wherein said element is provided with at least one layer comprising voids.

22. The method of claim 19 wherein said at least one photosensitive silver halide containing layer on the exposure side comprises absorber dyes.

23. The method of claim 22 wherein said backside silver halide containing layer and said front side silver halide containing layer comprise substantially the same silver halide grains.

24. The method of claim 19 wherein said exposure side silver halide grains are substantially slower than the backside silver halide grains.

25. The method of claim 19 wherein said element after exposure and processing for development has the exposure side and backside image of substantially the same density.

26. The method of claim 19 wherein said backside layer is coated on the side away from exposure with an antihalation layer.

27. The method of claim 19 wherein said base comprises at least one layer comprising $TiO_2$ in an amount of between 2 and 6%.

28. The method of claim 19 wherein said base is substantially free of $TiO_2$.

29. The method of claim 19 wherein said base material has a transmission of between 38 and 550%.

30. The method of claim 19 wherein said base has a stiffness of at least 150 millinewtons.

31. The method of claim 19 wherein said base comprises polyester.

32. The method of claim 19 wherein said base comprises polyolefin.

33. The method of claim 19 wherein said base comprises a biaxially oriented voided polyolefin sheet adhesively adhered to a transparent polyester sheet.

34. The method of claim 19 wherein said speed difference is about 0.3 log E.

35. The method of claim 19 wherein said speed difference is about 0.15 log E.

36. The method of claim 19 wherein said base comprises a voided polyester sheet adhesively adhered to a transparent polyester sheet.

37. A method of forming a display element comprising providing a photographic element comprising a base material, at least one exposure side photosensitive silver halide layer, and at least one backside photosensitive silver halide layer, wherein said face side photosensitive layer has lower speed than said backside photosensitive layer, and wherein said base material has a percent transmission of between 35 and 60%, exposing said photographic element, developing the exposed image, wherein said exposed image has an MTF difference of no more than 3 DMT between the exposure side image and the backside image, wherein said element after exposure and processing for development has the exposure side and backside image of substantially the same density.

38. The method of claim 37 wherein said element after exposure and processing for, development has an MTF difference of no more than 3 DMT between the exposure side image and the backside image.

39. The method of claim 37 wherein said element is provided with at least one layer comprising voids.

40. The method of claim 37 wherein said at least one photosensitive silver halide containing layer on the exposure side comprises absorber dyes.

41. The method of claim 37 wherein said backside silver halide containing layer and said front side silver halide containing layer comprise substantially the same silver halide grains.

42. The method of claim 37 wherein said backside layer is coated on the side away from exposure with an antihalation layer.

43. The method of claim 37 wherein said base comprises a biaxially oriented voided polyolefin sheet adhesively adhered to a transparent polyester sheet.

44. The method of claim 37 wherein the effective speed difference between the exposure side and the backside silver halide layers is no more than 0.6 log E.

45. The method of claim 44 wherein said speed difference is no more than 0.3 log E.

46. The method of claim 44 wherein said speed difference is no more than 0.15 log E.

47. The method of claim 37 wherein said base comprises a voided polyester sheet adhesively adhered to a transparent polyester sheet.

* * * * *